United States Patent [19]

Miyama et al.

[11] Patent Number: 4,812,716

[45] Date of Patent: Mar. 14, 1989

[54] ELECTRON BEAM SCANNING DISPLAY APPARATUS WITH CATHODE VIBRATION SUPPRESSION

[75] Inventors: Hiroshi Miyama, Yokohama; Yoshikazu Kawauchi, Kawasaki; Kaoru Tomii, Isehara; Jun Nishida, Tokyo, all of Japan

[73] Assignee: Matsushita Electric Industrial Co., Ltd., Kadoma, Japan

[21] Appl. No.: 847,311

[22] Filed: Apr. 2, 1986

[30] Foreign Application Priority Data

| | | | |
|---|---|---|---|
| Apr. 3, 1985 | [JP] | Japan | 60-70276 |
| Apr. 3, 1985 | [JP] | Japan | 60-70277 |
| Apr. 18, 1985 | [JP] | Japan | 60-82825 |
| Apr. 18, 1985 | [JP] | Japan | 60-82826 |
| May 20, 1985 | [JP] | Japan | 60-107350 |
| May 21, 1985 | [JP] | Japan | 60-108817 |

[51] Int. Cl.[4] ..... H01J 29/70; H01J 29/72

[52] U.S. Cl. ..... 315/366; 313/422

[58] Field of Search ..... 315/366; 313/422, 446, 313/632, 269, 278

[56] References Cited

U.S. PATENT DOCUMENTS

| | | | |
|---|---|---|---|
| 3,114,069 | 12/1963 | Peek, Jr. et al. | 313/269 |
| 3,567,988 | 3/1971 | Randmer et al. | 313/269 |
| 4,271,377 | 6/1981 | Gange et al. | 315/366 |
| 4,622,497 | 11/1986 | Miyama et al. | 313/422 |
| 4,714,863 | 12/1987 | Yokoyama et al. | 315/366 |

*Primary Examiner*—Theodore M. Blum
*Assistant Examiner*—Gregory C. Issing
*Attorney, Agent, or Firm*—Cushman, Darby & Cushman

[57] ABSTRACT

In a flat type cathode ray tube having one or plural parallel (vertical) line cathodes (10) and a plurality of scanning electrodes (12) consisting of insulated parallel (horizontal) metal strips, which are to be impressed with respective scanning pulses (FIG. 6, FIG. 21) to make vertical scanning of electron beams from the line cathodes: undesirable vibrations of the line cathode (10) are suppressed by touching wire-shaped dampers (28, 38A, 38B, 48, 64, 65) on the line cathode (10), and by selecting the frequency of the scanning pulses higher than natural vibration frequency of the line cathode (10).

31 Claims, 19 Drawing Sheets

FIG. 3 (a) (Prior Art)
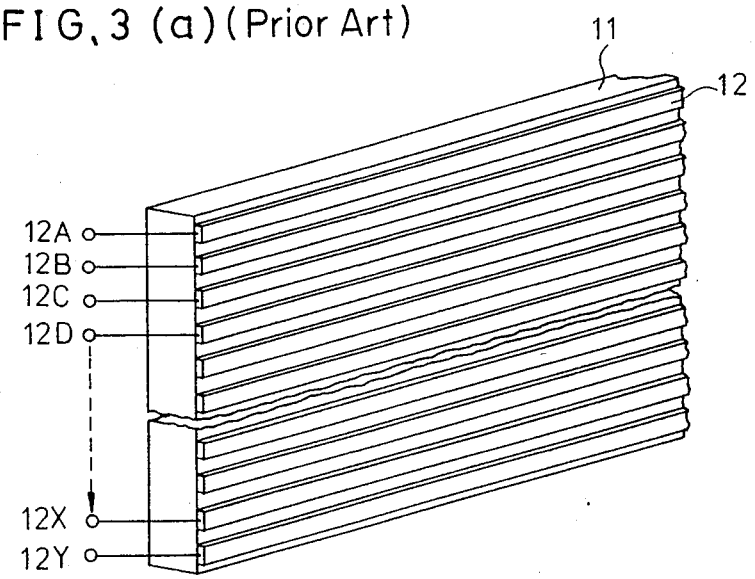
FIG. 3 (b) (Prior Art)
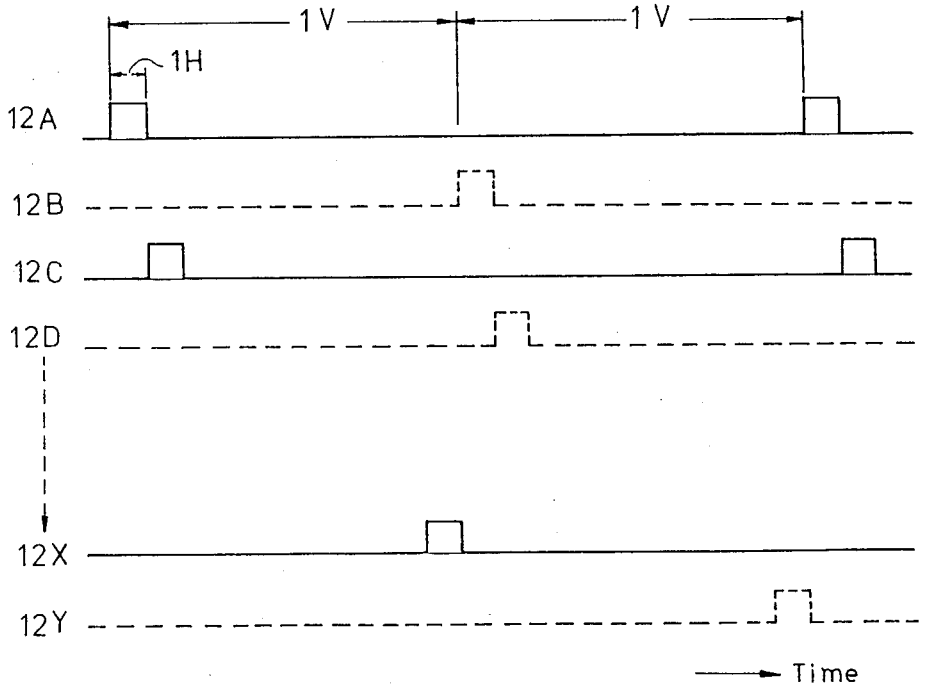

ELECTRON BEAM SCANNING DISPLAY APPARATUS WITH CATHODE VIBRATION SUPPRESSION

FIELD OF THE INVENTION AND RELATED ART STATEMENT

1. Field of the Invention

The present invention relates generally to an electron beam scanning display apparatus, and particularly concerns a flat type cathode ray tube especially suitable as a visual display apparatus of a computer terminal or a color television receiver.

2. Description of the Related Art

In recent years, flat type visual display apparatus have become widely used in the fields of image displaying or character displaying. Among such flat type display apparatus, a flat type cathode ray tube or an electron beam scanning display apparatus has been recently attracting attention. One such apparatus is disclosed in the U.S. Pat. No. 4,622,497 assigned to the assignee of the present invention. The configuration of the prior art is described with reference to FIG. 1. In the actual configuration of the flat type cathode ray tube of the prior art, a glass enclosure actually encloses all of the parts of the flat type cathode ray tube therein. But, for the sake of easy illustration of the electrode configurations, the vacuum enclosure is omitted, except for parts of the base panel and of the rear panel. In the drawing, horizontal and vertical directions are shown by arrow marks H and V, respectively. The prior art apparatus comprises a number of line cathodes 10 which are disposed in parallel vertical rows with a predetermined uniform pitch in a horizontal direction therebetween. Each line cathode has an electron emitting oxide layer on its surface, and in case the size of display screen is, for instance, 10 inches in the horizontal direction, the pitch in the horizontal direction of line cathodes 10 may be 10 mm. In this case, about 20 vertically disposed line cathodes of about 160 mm in length are disposed on an imaginary vertical plane. Behind the row of the line cathodes 10, a row of vertical scanning electrodes 12, which are horizontally disposed mutually insulated conductive strips, are disposed on an insulator panel 11. The vertical scanning electrodes 12 are used for, by scanningly applying pulses in turn to respective electrodes, controlling emissions of electron beams from the parts of the line cathodes disposed in front thereof. Therefore, they resultantly make a vertical scanning of emitted electron beams. A number of the vertical scanning electrodes 12 may be, in general, selected equal to the number of horizontal scanning lines (in case of NTSC system, the number is 480). In a modified embodiment, the number of the vertical scanning electrodes 12 may be a fraction of the number of horizontal scanning lines, when the flat type cathode ray tube has vertical deflection electrodes between the line cathodes and the phosphor screen. The flat type cathode ray tube further comprises a first grid ($G_1$) 13, a second grid ($G_2$) 14, a third ($G_3$) 15, a fourth grid ($G_4$) 16, horizontal deflection electrodes 18A, 18B, 18C . . . formed on insulator panel 19, a metal back electrode 8, a phosphor screen 7 and a face panel 9 which supports the last two members, in the above-mentioned order. The first grid 13 has vertical slits formed correspondingly in front of the line cathodes 10, is divided and is electrically isolated for respective parts corresponding to each line cathode, so as to perform beam current modulation for individual line cathodes. The second grid 14 is formed as one sheet and has vertical apertures similar to that of the first grid 13. The third grid 15 has a similar configuration to the second grid 14. The fourth grid 16 has a number of horizontally oblong small slits, whose widths are no less than widths of vertical slits of the second grid 14 or the third grid 15. The horizontal deflection electrodes 18A, 18B, 18C . . . are formed by plating, vacuum deposition or a similar means on insulator plates 19, 19. These are disposed vertically and in a parallel direction with the running direction of the electron beams. The horizontal deflection electrodes 18A, 18B, 18C . . . are for making horizontal deflection and horizontal focussing; and the horizontal deflection electrodes are symmetrically disposed with the position of non-reflected electron beams from the respective line cathodes, hence with the same pitch horizontal direction as the pitch in the horizontal direction of the line cathodes 10. In the case of color displaying, the phosphor screen 7 comprises stripes or dots of red phosphor, green phosphor and blue phosphor.

Next, the operation of the above-mentioned flat type cathode ray tube is elucidated with reference to FIG. 2. By flowing current in the line cathodes 10, the line cathodes are heated. Substantially the same potential as that of the line cathodes 10 are applied to the first grid 13 and the vertical scanning electrode 12. At that time, electron beams from the line cathodes 10 travel towards the first grid 13 and second grid 14 by applying voltage to the grids in a manner that a higher voltage (by about 100–500 V) than the potential of the line cathodes 10 is applied to the second grid 14, so that the electron beams pass through the slits formed on the grids 13. Then, the amount of the electron beams passing through the slits of the first grid 13 and the second grid 14 is controlled by changing the potential applied to the first electrode 13. The electron beams which pass through the slits of the second grid 14 travel through the third grid 15 and the fourth grid 16, and further through spaces formed by parallel disposition of horizontal deflection electrodes 18A, 18B and 18C. Predetermined voltages are impressed on these grids and electrodes so that the electron beams are focussed onto the phosphor screen 7, making small spots. Beam focussing in the vertical direction is made by a static lens which is formed at outlet part of the slits of the fourth grid 16, and beam focussing in horizontal direction is obtained by changing central voltages to be impressed on the horizontal electrodes 18A, 18B and 18C. The horizontal deflection electrodes 18A, 18B and 18C are connected by means of common bus line pairs $18A_a$, $18A_b$, $18B_a$, $18B_b$, $18C_a$ and $18C_b$; and furthermore, deflection power signal of saw tooth wave or step like wave having period of horizontal scanning is superposed through the base lines on respective horizontal focussing voltages simultaneously, and respective electron beams are deflected in horizontal direction by a predetermined width. Next, the electron beams after deflection stimulate the phosphor screen 7 and produce a light image on the phosphor screen. Further, in case of obtaining a color image or the like, a modulation signal corresponding to a color of a respective phosphor to which the electron beams are landing are impressed on the first grid 13 when the electron beams horizontally scan the phosphor screen.

Next, vertical scanning is elucidated with reference to FIG. 3(a) and FIG. 3(b). As aforementioned, by controlling voltages of the vertical scanning electrodes 12 to be positive or negative, thereby inducing the potential of the spaces surrounding the line cathod 10 to be positive or negative, respectively, a generation or ceasing of the electron beams from the line cathodes 10 are controlled. At this time, when the distance between the line cathode 10 and the vertical scanning electrode 12 is small, the voltage required for controlling the generation and termination of the electron beams can be made small. In case an interrace system is adopted, in the first field period, one of the vertical scanning electrodes 12A is impressed with a signal to make and generate signals from the line cathode 10 generate (a state hereinafter referred to as ON) the electron beams for one horizontal scanning period (1H). In the next 1H period another signal to turn the electron beam ON is applied to the vertical scanning electrode 12C. Thereafter the above-mentioned two steps are repeated alternately in sequence. Thereby, signals to turn the electron beam ON are sequentially applied to every other vertical scanning electrode. When at last a bottom vertical scanning electrode 12X corresponding to the bottom of the displayed image is impressed with the ON signal, a vertical scanning of a first one field is completed. Vertical scanning of the subsequent second field is made by impressing an ON signal to generate the electron beam in 1H period in a similar manner to that discussed above, by starting from a vertical scanning electrode 12B, and thereafter by scanning to a vertical scanning electrode 12Y ultimately. Therefore, one frame vertical scanning is completed.

In the above-mentioned configuration of the flat type cathode ray tube, as shown in FIG. 4, a DC power source 23 is connected across a line cathode 10 which is provided between the vertical scanning electrode 12 and the first grid 13. Here lies a problem, in that by electrifying the line cathode 10, a potential difference arises across both ends of the line cathode 10. Therefore, in order to stop generation of the electron beam by the line cathode 10, the signal voltage to be impressed to the vertical scanning electrodes 20 must be selected such that signal voltages to be impressed on the vertical scanning electrodes are controlled so as to make the potential differences between the line cathodes 10 facing thereto become uniform. Furthermore, other ones of the vertical electrodes besides the one vertical scanning electrode 12, should be impressed with such a potential to make a uniform potential difference against respective parts of the line cathodes 10 so as not to produce electron beams therefrom. If such controlling made theoretically, by adding collection voltages to the line cathodes 10 and to the vertical scanning electrodes 13, the circuit configuration becomes very complex, and at the same time power consumption of the apparatus becomes great.

When a large sized picture is desired, the line cathodes 10 becomes long, and mechanical vibration of the line cathode 10 becomes a problem. The line cathodes 10 are stretched by a spring on one side or on both sides thereof, and they are liable to vibrate similar to chords that are supported at both ends. Then natural frequency $f_k$ of such chord is given by the following equation:

$$f_k = \frac{n}{2l}\sqrt{\frac{S}{M_T}}, \quad (1)$$

wherein l is an length of the line cathode, n is order number (1, 2, 3, . . . ), $M_T$ is mass per unit length of the chord (gr/cm), and S is tension of the chord in steady state (gr). In general, the natural frequency $f_k$ is about 300–500 Hz. The line cathodes having such natural frequency vibrate when triggered by an outside force or impressing of electric pulses or the like.

In the above-mentioned conventional configuration, when the picture size becomes large, and hence the line cathodes 10 become long, the retaining of gaps between the line cathodes 10 and the vertical scanning electrodes 12 and the first grid 13 within a predetermined acceptable tolerance limit becomes difficult. Furthermore, since the line cathodes are made of thin wires of 15–50 μm diameter coated by cathode oxide and both ends thereof are held by fixing members and spring members to stretch the line cathodes with its parts untouched by anything in vacuum space, they are very liable to vibrate. Generation of such vibration causes undesirable touching and hence electric shortcircuiting of the line cathodes with other electrodes or grids, and in addition causes an undesirable swinging of the displayed image.

OBJECT AND SUMMARY OF THE INVENTION

The present invention is intended to solve the above-mentioned problems and to provide an electron beam scanning display apparatus wherein vibration of the line cathodes is prevented and furthermore electric potential corrections of the line cathodes are unnecessary.

Another purpose of the present invention is to provide anti-vibration device of the line cathodes which can prevent undesirable vibration of line cathodes leading to damage thereof and capable of stabilizing electron beam flow hence improving reliability.

Electron beam scanning display apparatus in accordance with the present invention comprises:

plural line cathodes each stretched between a pair of holders, a plural of scanning electrodes which are each other insulated and disposed substantially perpendicular to the direction of the line cathodes with predetermined gaps to and behind the line cathodes, for producing electron beams by application of predetermined potentials thereto, a face plate disposed facing the plural line cathodes with a certain distance therebetween and having a display screen on its inner face, deflection electrodes disposed between the line cathodes and the face plate for deflecting at least a part of the electron beams, and vibration-suppressing means for suppressing vibration of the line electrodes.

One of the vibration-suppressing means comprises a line cathode power source connected through a diode to one end of the line cathodes and a pulse voltage source having a pulse signal frequency higher than natural vibration frequency of the line cathode and connected to the other end of the line cathode in a manner that the polarity of the pulse signal is backward to the diode.

Another vibration-suppressing means comprizes vibratrion damping member provided to contact a part of the line cathodes so as to damp the vibration of the line cathode.

BRIEF DESCRIPTION OF THE DRAWINGS

FIG. 3(*a*) is a partial perspective view of a rear plate 11 and vertical scanning electrodes 12 of the flat type cathode ray tube of FIG. 1.

FIG. 3(*b*) is time chart showing wave-shapes of voltages to be impressed on the vertical scanning electodes of FIG. 3(*a*).

FIG. 19, FIG. 20, FIG. 21 and FIG. 22 show still another embodiment wherein FIG. 19 is a partial perspective view, FIG. 20 is a partial sectional plan view, FIG. 21 is a time chart of wave forms of various part and FIG. 22 is a partial perspective view showing line cathode holding parts.

DETAILED DESCRIPTION OF THE INVENTION

Figure 5:
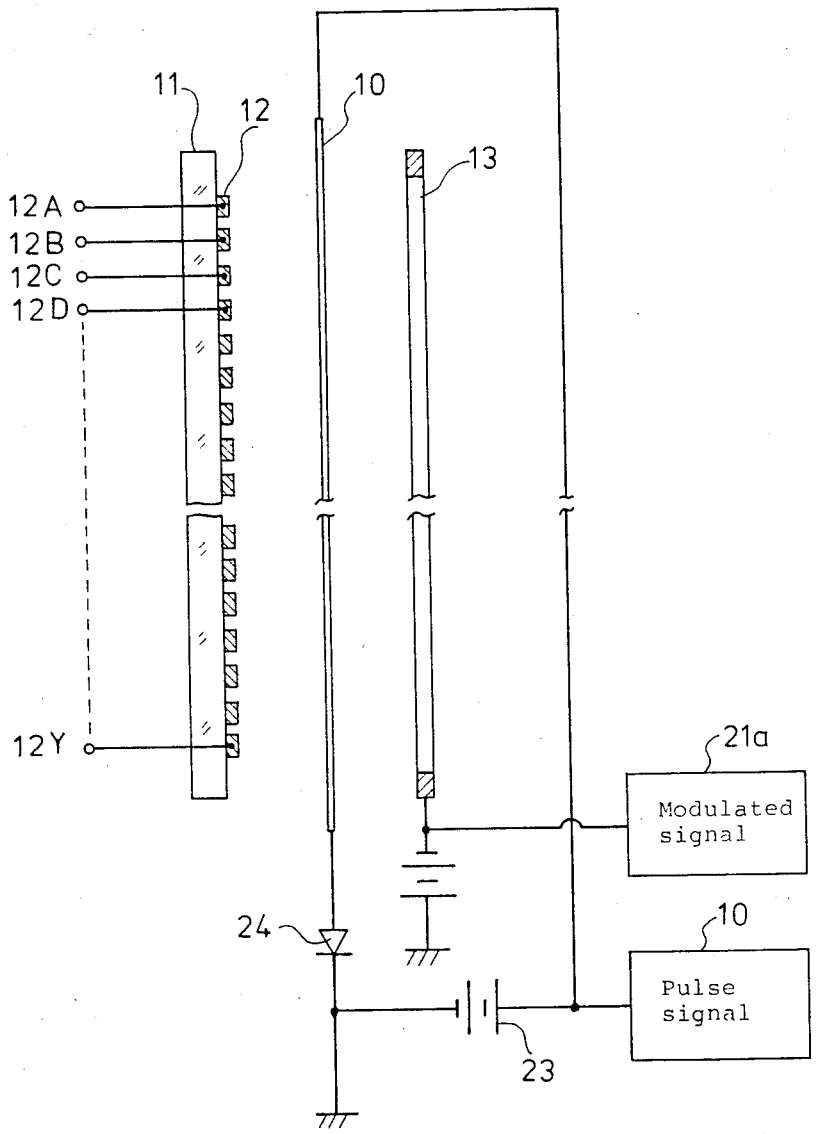
FIG. 5 is a schematic vertical sectional view of a rear part of a flat type cathode ray tube embodying the present invention.

FIG. 5 is a vertical cross-sectional view of a rear part, which is a part of electron beam source, of a flat type cathode ray tube embodying the present invention. The fundamental configuration of the flat type cathode ray tube is similar to that shown in FIG. 1, and a description on the general configuration and operation therefor applies also to this embodiment. As shown in FIG. 5, line cathodes 10, disposed between the vertical scanning electrode 12 and the first grid 13, are connected through a diode 24 across a cathode power source 23. The vertical scanning electrodes 12 include a vertically disposed row of horizontally oblong conductor strips, and a number of the conductor strips is selected to be the number of horizontal scanning lines or a fraction thereof. Each line cathode is made by coating an electron emitting oxide layer of 5–20 μm thickness on a tungsten wire of about 15–50 μm diameter, with both ends thereof fixed by using stretching spring at least on one end, so as to be straight and to maintain a predetermined gap to the vertical scanning electrodes 12. In case a size of the display screen is, for instance, 10 inches in the horizontal direction, the pitch in the horizontal direction of the line cathodes may be 10 mm, and about 20 vertically disposed line cathodes of about 160 mm length are disposed on an imaginary vertical plane. The vertical scanning electrodes 12 are disposed horizontally on an insulator panel 11. The vertical scanning electrodes, by scanning application of pulses in turn to respective electrodes, emit electron beams from the parts of the line cathodes disposed in front thereof, and thereby perform a vertical scanning of emitted electron beams. The number of the vertical scanning electrodes may be, in general, selected equal to the number of horizontal scanning lines (in case of NTS system, the number is 480). The first grid 13, which is disposed in front of the line cathodes, has vertical slits formed correspondingly in front of the line cathodes 10, and is divided and electrically isolated for respective parts corresponding to each line cathode, so as to beam current module the individual line cathode.

Figure 6:
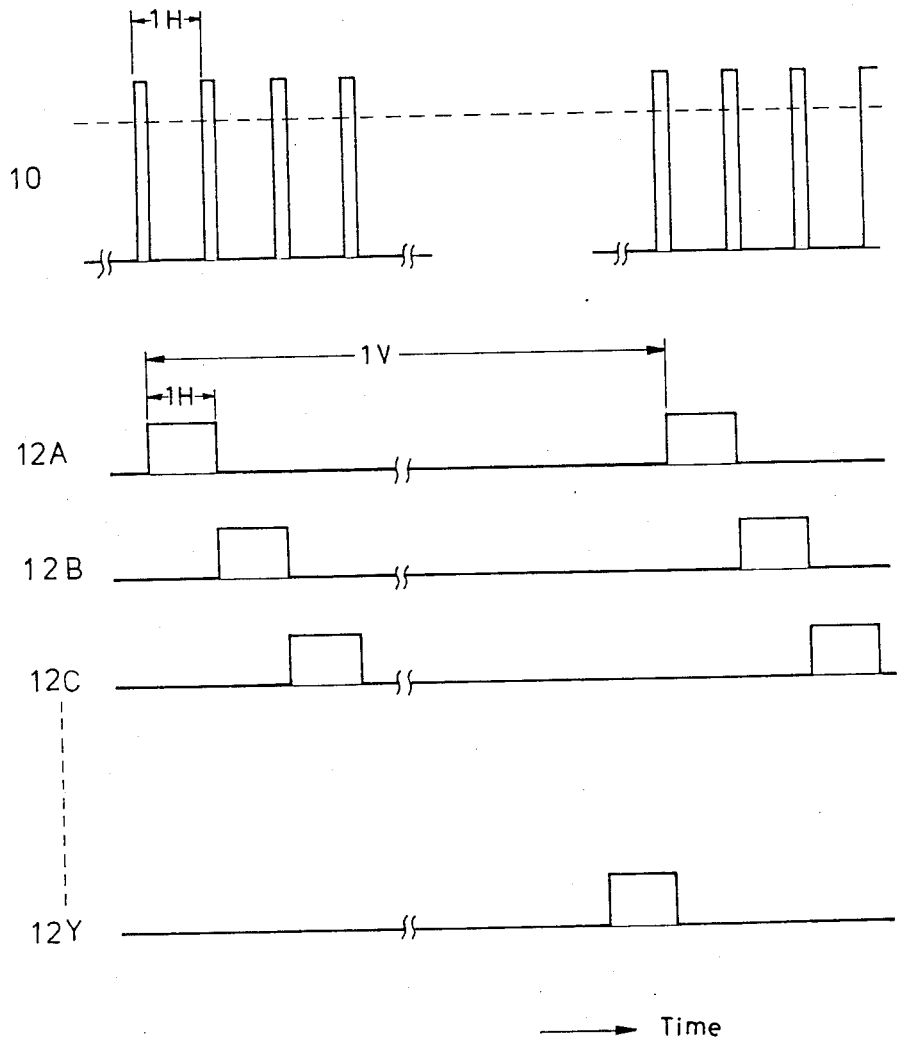
FIG. 6 is a time chart showing waveforms of various parts of the embodiment of FIG. 5.

Next, signals to be applied to respective electrodes and line cathodes are elucidated. Pulse signals to be impressed on respective vertical scanning electrodes 12*a*, 12*b*, 12*c*, . . . 12*x* and the line cathodes 10 are shown in FIG. 6 by the same numerals. Voltage from the DC cathode power source 23, and a pulse signal having a frequency which is higher than the natural frequency of mechanical vibration of the line cathode 10 is superposedly applied to line cathodes 10. Here, the elucidation is made by taking one example where the pulse signal becomes ON and OFF with a 1H horizontal scanning period of the television signal. The emission of the electron beam from the line cathode becomes ON and OFF responding to the ON and OFF of the pulse signal 10. And by applying electron-beam-taking-out pulses 12*a*, 12*b*, 12*c* . . . 12*y*, respectively to the vertical scanning electrodes during the OFF periods of the above-mentioned pulse signal to be applied on the line cathodes, the influence of undesirable potential differences across both ends of the line cathodes can be completely omitted. Hereupon, a diode 24 is connected at one end of the line cathode 10, so as to stop reverse current to the line cathode. By selecting the pulse signals 12*a*, 12*b*, . . . 12*y*, to be lower than potentials to be applied to the grids 13, 14, 15 and 16, it becomes possible to take out the electron beams by the electric fields formed by an electron lens formed by the first grid to the fourth grid 13, 14, 15 and 16, by means of higher potentials of the grids in comparison with the potential of the line cathode 10.

To respective ones of the vertical scanning electrodes 12*a*, 12*b*, 12*c*, . . . 12*y*, the pulse signals 12*a*, 12*b*, 12*c*, . . . 12*y*, which are synchronized to the pulse signal applied to line cathodes 10, are impressed in a manner that a period of application of the ON pulse to the vertical scanning electrodes moves from upper parts to the lower parts as shown in FIG. 6; and such moving repeats. On respective first grids 13, the modulation signal 21*a* is applied in synchronism with the above-mentioned pulses.

As shown in FIGS. 1–6, flat type cathode ray tube further comprises a first grid ($G_1$) 13, a second grid ($G_2$) 14, a third ($G_3$) 15, a fourth grid ($G_4$) 16, horizontal deflection electrodes 18A, 18B, 18C formed on insulator plates 19, a metal back electrode 8, a phosphor screen 7 and a face panel 9 which supports the last two members, in the above-mentioned order. The first grid 13 has vertical slits formed correspondingly in front of the line cathodes 10 and is divided and is electrically isolated for respective parts corresponding to each line cathode, so as to make beam current modulation for individual line cathode. The second grid 14 is formed as one sheet and has vertical apertures similar to that of the first grid 13. The third grid 15 has the similar configuration to the second grid 14. The fourth grid 16 has a number of horizontally oblong small slits, whose widths are no less than widths of vertical slits of the second grid 14 or the third grid 15. The horizontal deflection electrodes 18A, 18B, 18C are formed by plating or vacuum deposition or the like means on insulator plates 19, 19 . . . which are disposed vertically and in parallel direction with running direction of the electron beams; the horizontal deflection electrodes 18A, 18B, 18C are for making horizontal deflection and horizontal focussing; and the horizontal deflection electrodes 18A, 18B, 18C are disposed in symmetry with regard to axis of non-deflected electron beams from respective line cathodes, hence with the same pitch in horizontal direction as the pitch in horizontal direction of the line cathodes 10. In case of color displaying, the phosphor screen 7 comprises stripes or dotts of red phosphor, green phosphor and blue phosphor.

Since the line cathodes 10 are chord fixed at their both ends and suspended in open space, each one has natural vibration frequencies. Therefore, depending on the frequency of pulse signal to be applied thereon, a resonant mechanical vibration of the line cathodes may be caused. Especially when the frequency of the pulse signal is lower than the natural viabration frequency of the line cathodes, undesirable mechanical vibration by resonance is likely to be triggered thereby, due to a higher harmonic wave of the pulse signal. In order not to make such undesirable mechanical resonance, the natural vibration frequency of the line cathodes should be selected to be lower than the frequency of the pulse signal to be applied for heating the line cathodes. Since the frequency of the pulse signal is synchronized with the horizontal scanning frequency of the image signal, i.e., 15.75 KHz, the natural vibration frequency should be selected sufficiently lower than that; for instance, it should be 250 to 400 Hz.

Besides the above-mentioned embodiment, such a modified embodiment may be made that the vertical scanning electrodes 12 are provided in a front side position with regard to the line cathodes.

In the above-mentioned embodiment, since the electric power to heat the line cathode is supplied only in a very short pulse time which is only a small fraction of one horizontal scanning time (1H), during the period of electron beam generation no potential differencies are produced lengthwise of the line cathodes, and processing of generation of driving signal to be impressed on the scanning electrodes and deflection electrodes becomes simple. Furthermore, by the selection of the frequency of the line cathode heating signal higher than the natural vibration frequency of the line cathode, undesirable mechanical vibration due to higher harmonics of the heater current is prevented.

Figure 7:
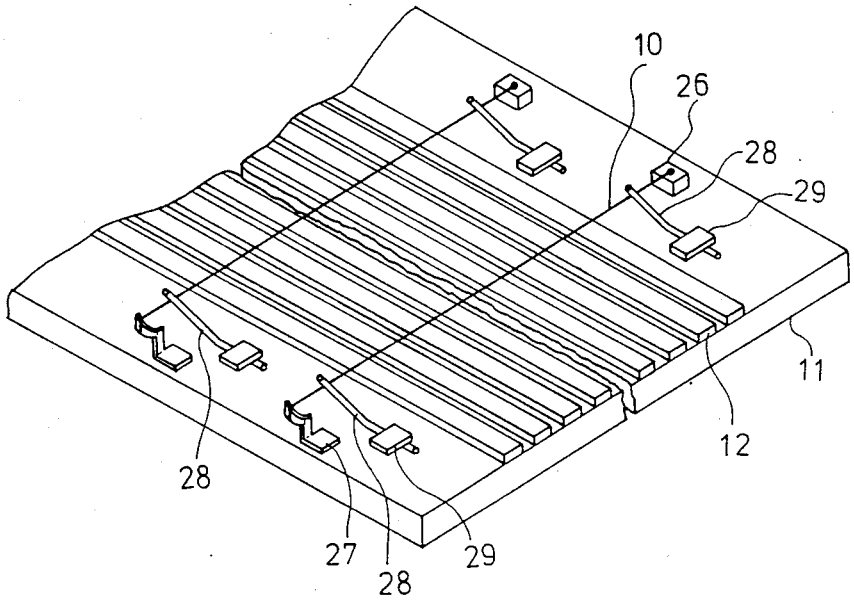
FIG. 7 and FIG. 8 are perspective view and partial sectional view of one embodiment showing mechanical vibration-suppressing means in accordance with the present invention.
Figure 8:
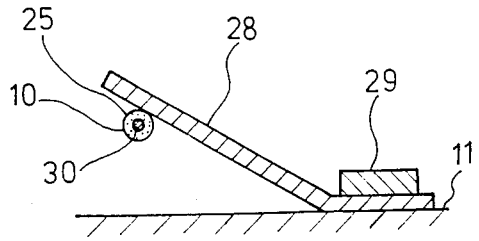

In order to prevent the vibration of the line cathodes, another measure is taken. FIG. 7 shows one embodiment of such vibration suppressing means. As shown in FIG. 7, on the insulator panel 11, such as of glass or the like material, vertical scanning electrodes 12 are formed with a predetermined pitch by photo-etching or photolithographic method. Between the vertical scanning electrodes 12 and the first grid 13, a predetermined number of line cathodes 10 are stretched in a vertical direction in a manner to face the electron beam passing apertures in the first grid 13. The line cathodes 10 are made of tungsten wires 30 of 15–50 μm diameter having an electron emitting oxide layer 10' of about 5–20 μm thickness, as shown in FIG. 8. The line cathodes 10 are stretched by a spring or springs at one end or both ends. In the example of the figure, one end is fixed to a fixing member 26 and the other end is fixed to a resilient holder 27 on a insulator panel 11, respectively by welding or the like method. At both ends of the line cathodes 10, thin rod shaped dampers 28, 28 are provided on a side part of the line cathodes 10. The thin rod dampers 28, 28 are made of thin rod or wire sheathed with insulator sleeves, or made of thin rod of insulating substance. They have diameter in a range of 50–200 μm, and one end of each is fixed by a fixing piece, with the other end being disposed apart by tilting upwards from the face of the insulator panel 11 and with the free end part is touching the line cathode 10. Besides the example of the drawings wherein the thin rod dampers 28 are fixed on the insulator panel 11 of insulating substance by the fixing pieces, in another modified case, the line cathodes 10 may be fixed by a heat resistive bond such as frit glass or may be fixed by welding on a small piece of metal plate bonded on the insulator panel 11.

The effect of the above-mentioned examples are elucidated. When the flat type cathode ray tube receives mechanical vibration, the vibration of the line cathode 10 is absorbed by the dampers 28, and therefore the vibration is prevented. Results of measurement of vibration under the same conditions for the line cathodes 10 of the example of the present invention and line cathodes of the prior art which do not use the thin rod dampers 28 are shown in FIG. 9.

Figure 9:
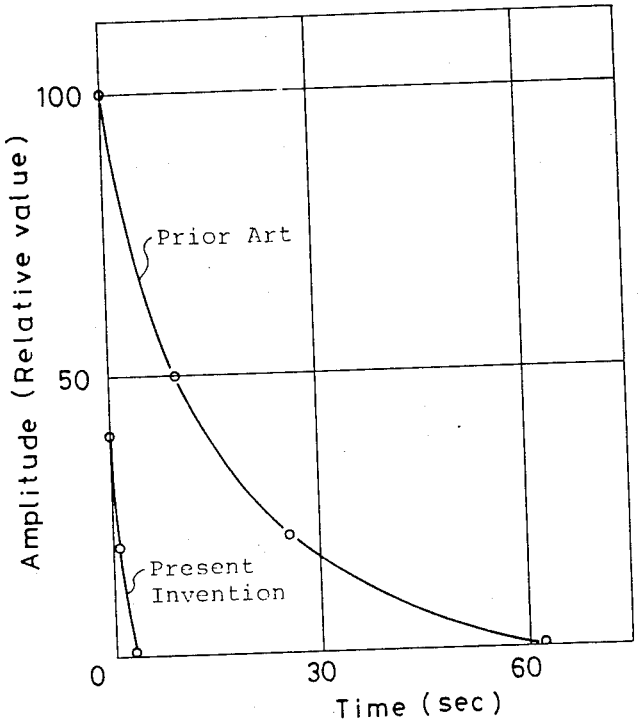
FIG. 9 is a graph showing characteristics of the embodiment of the present invention and a comparison to the prior art.

In FIG. 9, the abscissa is graduated by time, and the ordinate is graduated by amplitude of vibration in relative value. The graph shows that according to the embodiment of the present invention, vibration amplitude is decreased to $\frac{1}{2}$–$\frac{1}{3}$ in the absolute value in comparison with the prior art, and with regard to vibration attenuation time, time of the present invention is decreased to 1/10–1/20 in comparison with the prior art. Therefore, according to the embodiment of the present invention, electric shortcircuit of the line cathodes 10 with the vertical scanning electrode 12 can be prevented and resultant damage can be prevented. In addition, the flow of electron beam generated from the line cathode 10 can be stabilized.

Figure 10:
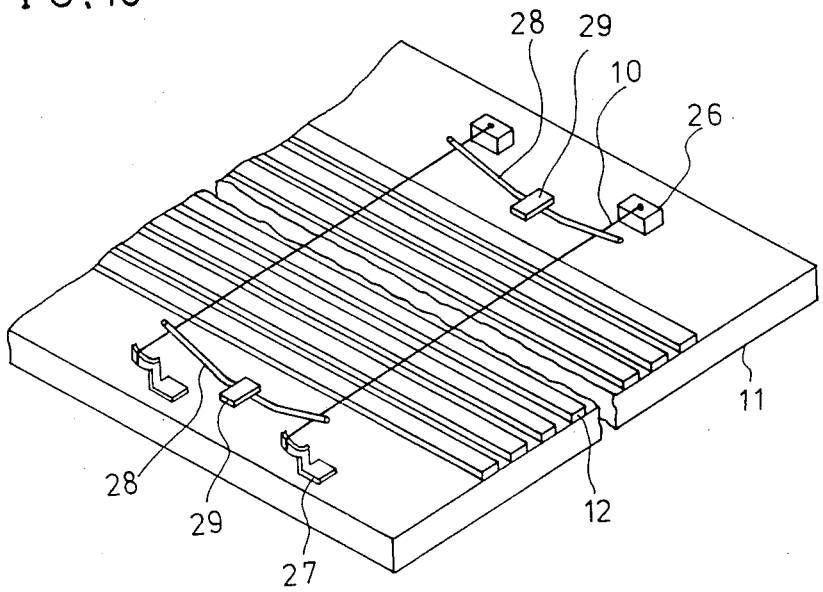
FIG. 10 is a perspective view of another embodiment of the present invention.

Next, a second embodiment of the present invention is elucidated with reference to FIG. 10. In this example, thin rod dampers 28 are fixed by its central parts by fixing pieces 29 fixed on the insulator panel 11, and both ends of the thin rod dampers are bent upwards and touch the line cathodes 10. Other configurations are the same as the first embodiment. In this example, number of thin rod dampers 28 becomes half of the first embodiment, and therefore manufacturing steps of the flat type cathode ray tube becomes more simple than the prior art.

The positions if disposing the dampers 28 are not necessarily be at both end parts of the line cathodes, but the dampers 28 may be provided only on one end part of the line cathodes. With regard to the position to provide the thin rod dampers 28, the parts of the line cathodes corresponding to the outside parts of the picture range is preferable, but they may be provided in such a part to correspond to the range within the picture, provided that the thin rod damper is such thin as not to hinder the electron beams. The thin rod dampers may be touched on the metal core wire 30 of the line cathodes 10 by partly removing the electron emitting oxide layer 25.

The thin rod dampers 28 may be provided on the surface of the first grid 13, instead of the insulator panel 11.

As is obvious from the above-mentioned elucidation, according to the embodiment of the present invention, free end part of the thin rod dampers are contacted on line cathodes stretched for electron generation. Therefore, by means of the dampers, the vibration of the line cathodes can be prevented. Or even when making vibrations, they can be stopped in short time, and prevent damages of line cathodes due to shortcircuiting with other electrode; and further, electron flow generated from the line cathodes are stabilized, thereby to prevent swinging of the image. Of course, since the thin rod dampers are made to contact the line cathodes with slight pressures, no substantial displacements of the line cathodes by the pressing of the damper is made.

Figure 11:
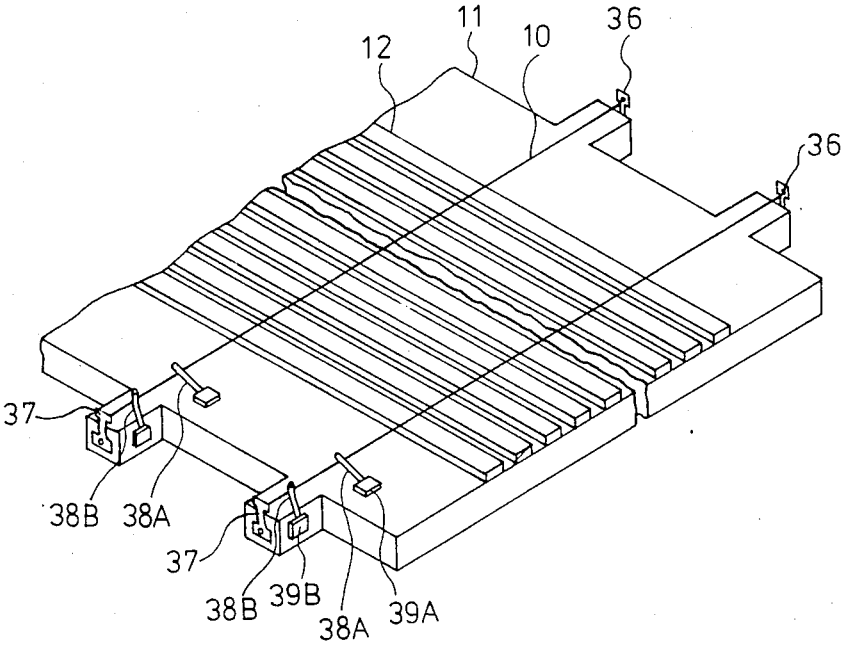
FIG. 11 and FIG. 12 are perspective view and partial sectional view, respectively, of still another embodiment of mechanical vibration suppressing means of the present invention.
Figure 12:
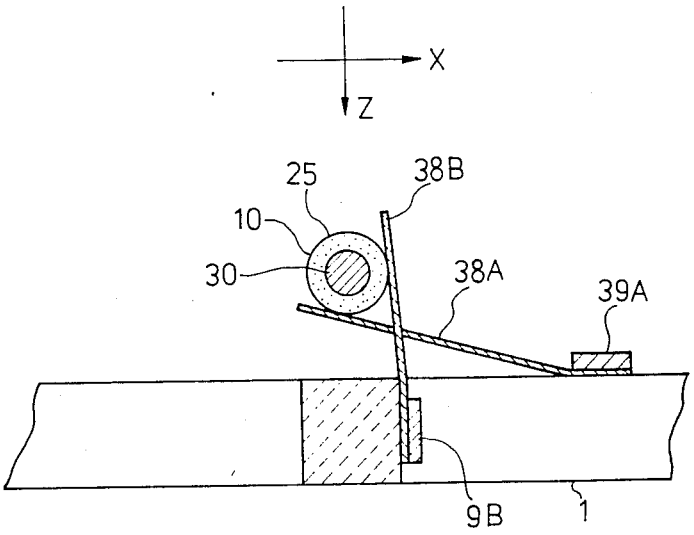
Figure 13:
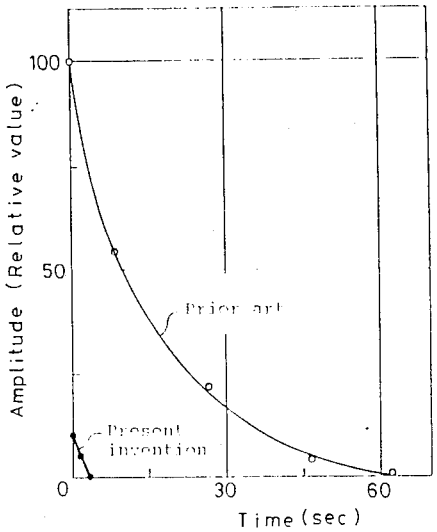
FIG. 13 is a graph showing characteristics of the embodiment of FIG. 11 and FIG. 12 and a comparison prior art.

One actual embodiment of the line cathode stretching member is described with reference to FIG. 11 through FIG. 13. Vertical scanning electrodes 12 for switching in the vertical direction of the picture for electron beams for scanning are provided with a predetermined pitch in vertical rows of horizontal electrodes on an insulator panel 11. The vertical scanning electrodes are made of transparent electrode or metal film by photoetching working on the insulator panel 11, e.g. of glass in a manner to make electrically divided horizontal strips. Between the vertical scanning electrodes 12 and the first grid 13, a predetermined number of line cathodes 10 are stretched in vertical direction on an imaginary vertical plane in a manner respectively to face the electron beam passing apertures in the first grid 13. The line cathodes 10 are made by tungsten wires 30 of 15–50 μm diameter having electron emitting oxide layer 10' of about 5–10 μm thickness, as shown in FIG. 12. The line cathodes 10 are stretched by spring or springs 37 at one end or both ends. In the embodiment shown in the drawings, one end is fixed by provided on one end of the insulator panel 11, and the other end of the line cathode is fixed to the spring member 37 provided on the other end of the insulator panel 11. The line cathode 10 are touched by plural vibration preventing dampers 38A and 38B at one end part thereof. Each vibration preventing dampers 38A and 38B is made of a metal wire or a metal wire sheathed by insulative substance or made of insulated thin rod, and diameter thereof is about 30–200 μm. The vibration preventing dampers 38A and 38B are fixed by fixing members 39A and 39B by heat resistive bond (frit glass) to the insulator panel 11 at their fixing ends. Free ends of the vibration preventing dampers are made to touch the line cathode 10 in a manner to pinch it by the plural thin rod-shaped vibration preventing dampers 38A and 38B, making an acute angle. In the embodiment of FIG. 12, respective vibration preventing dampers 38A and 38B are respectively in directions X and Z, and lightly hold the line cathode 10 in X direction and Z direction, respectively.

Since the line cathode 10 is held by the vibration preventing dampers 38A and 38B in different direction, i.e., X and Z directions, even when the line cathode makes vibrations in X direction and Z direction, the vibration preventing dampers 38A and 38B can suppress the vibration in the X direction and the Z direction by frictions. With respect to the effect of these dampers 38A and 38B, in comparison with the prior art having no such dampers but having other conditions the same as the above-mentioned embodiment, result of accessment of the vibration is shown in FIG. 13. In the graph of FIG. 13, abscissa is graduated by time and the ordinate is graduated by amplitude, and the curves show characteristics of time constants to stops of the measured vibration. As is obvious from the graph, according to the embodiment of the present invention, in comparison with the prior art the absolute value is decreased to 1/5–1/10, and the vibration attenuation becomes 1/10–1/50.

Figure 14:
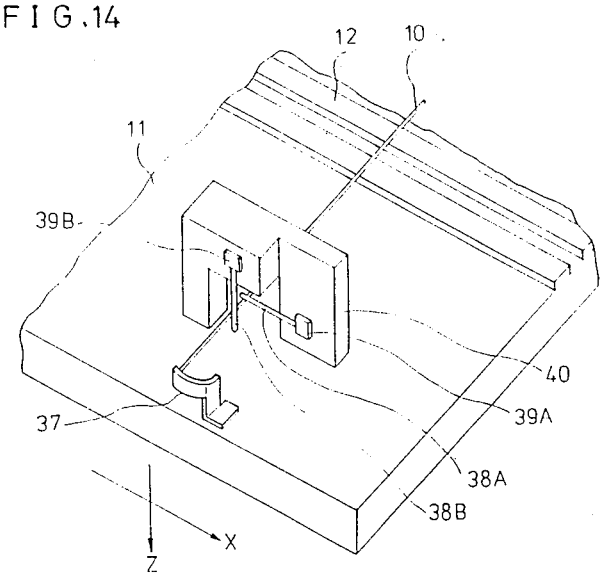
FIG. 14 is a perspective view of further embodiment of the present invention.

Next, a fourth embodiment of the present invention is elucidated with reference to FIG. 14. In this example, a holder 40 is provided being bestriding over a line cathode 10 which is stretched on an insulator panel 11, and vibration preventing dampers 38A and 38B are fixed by heat resistive bond (frit glass) and by fixing pieces 39A and 39B. And free end tip parts of the vibration preventing dampers 38A and 38B touches the line cathode 10 in X direction and Z direction, respectively. Other configuration is the same as that of the first embodiment. According to this embodiment, the dampers 38A and 38B can be provided almost on the same vertical plane, so that the vibration can be damped more effectively. Furthermore, since the dampers 38A and 38B are provided on the holder 40, providing of the dampers 38A and 38B can be made only by fixing the holder 40 on the insulator panel 11. Since the vibration preventing dampers 38A and 38B can be mounted in one step, the manufacturing steps becomes simple.

The above-mentioned dampers 38A and 38B may be provided on both end parts of the line cathode 10. With regard to the positions to provide the dampers 38A and 38B, the parts of the line cathodes corresponding to the outside parts of the picture range is preferable; but they may be provided in such part as corresponding to the range within the picture, provided that the thin rod damper is thin enough so that it does not to hinder the electron beams. The dampers 38A and 38B may be touched on the metal core wire of the line cathode at the part where the electron emitting oxide layer 25 is omitted. The dampers provided in different angles with respect to the line cathode 10 may be of a number of more than two. In the above-mentioned embodiment, the line cathodes 10 are provided on the insulator panel whereon the vertical scanning electrodes 12 are provided, but it is possible to provide the line cathodes 10 and the dampers 38A and 38B on an insulator panel having the first grid thereon.

As is obvious from the above-mentioned embodiment, since the vibration preventing dampers are provided to hold the line cathode in different direction by their free ends, undesirable vibration of the line cathodes by electric or mechanical influence can be protected. And even when a vibration takes place, the time to ending of the vibration is drastically shortened. Of course, since the pressure of touching of the free end of the vibration preventing dampers 38A and 38B on the line cathodes are light, such touching of the dampers does not substantially change the position of the line cathode. Since the vibration of the cathode is prevented as above, undesirable electric shortcircuit of the line cathodes to the electrodes, and resultant damaging thereof can be prevented, and electron flow generated from the line cathode is stabilized and hence swinging of picture on the phosphor screen can be prevented.

Figure 15:
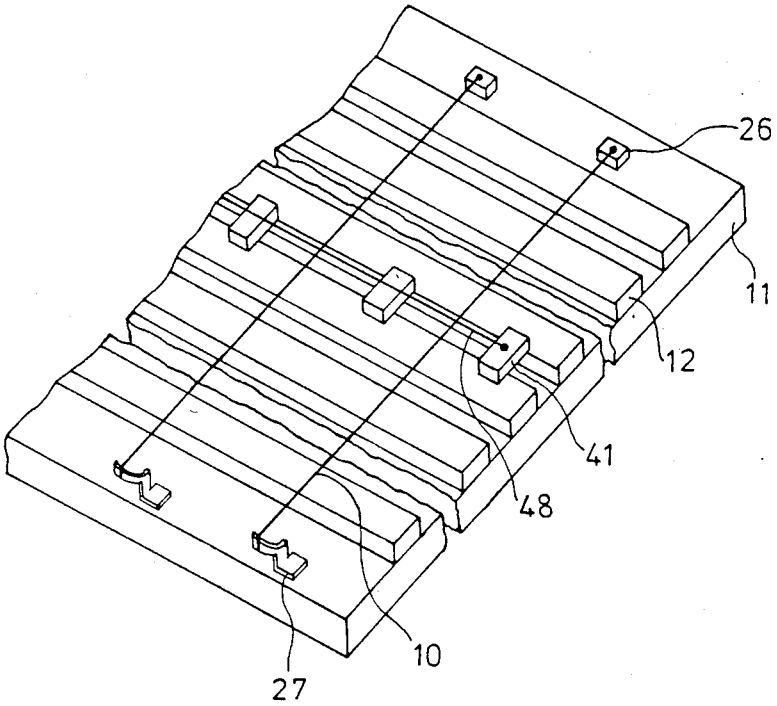
FIG. 15, FIG. 16 and FIG. 17 are a perspective view, an enlarged partial perspective view and an enlarged sectional view, respectively, of still another embodiment.
Figure 16:
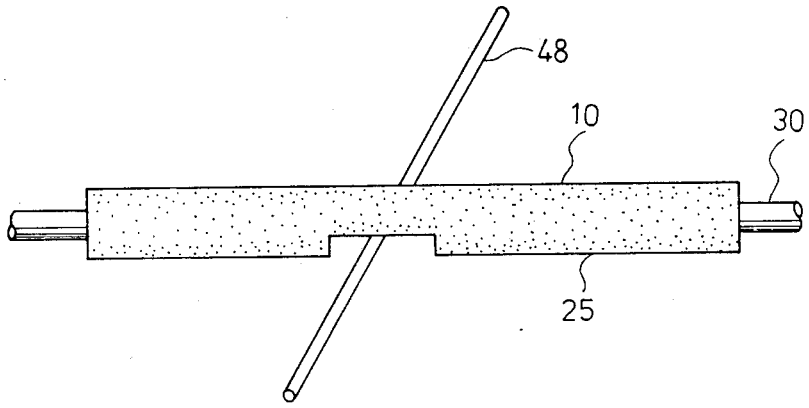
Figure 17:
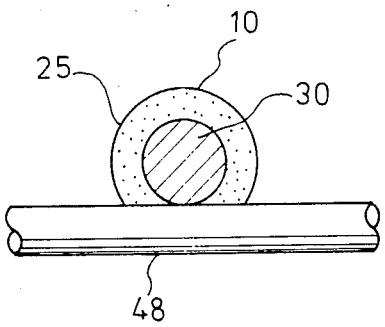

Another embodiment of the line cathode stretching device in accordance with the present invention is elucidated with reference to FIG. 15 through FIG. 17.

Figure 1:
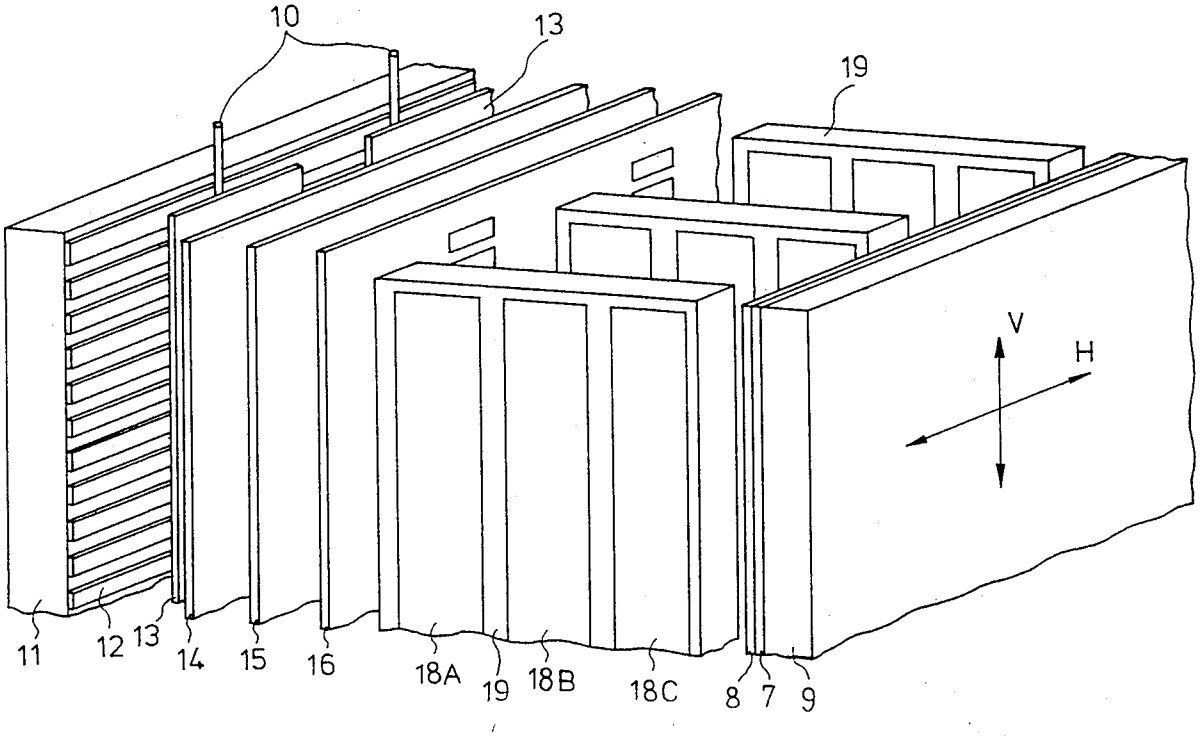
FIG. 1 (Prior Art)
FIG. 1 is the partial perspective view of general configuration of a prior art flat type cathode ray tube.
Figure 2:
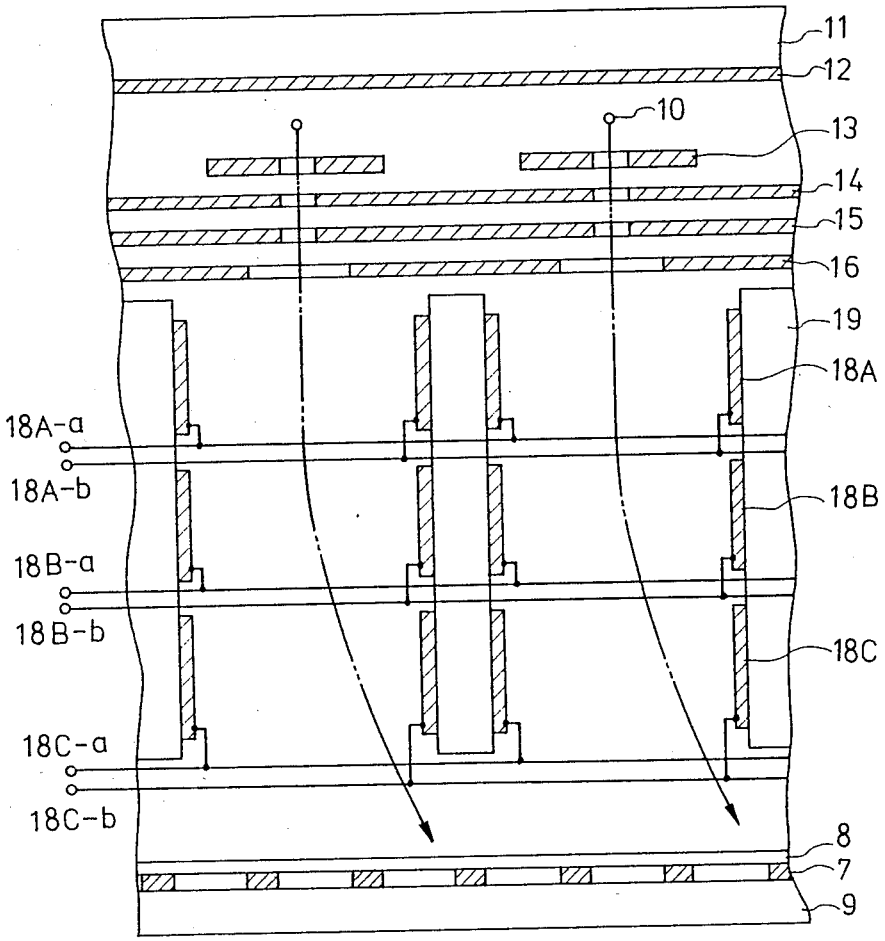
FIG. 2 (Prior Art)
FIG. 2 is a partial sectional plan view of the configuration of the flat type cathode ray tube of FIG. 1.
Figure 4:
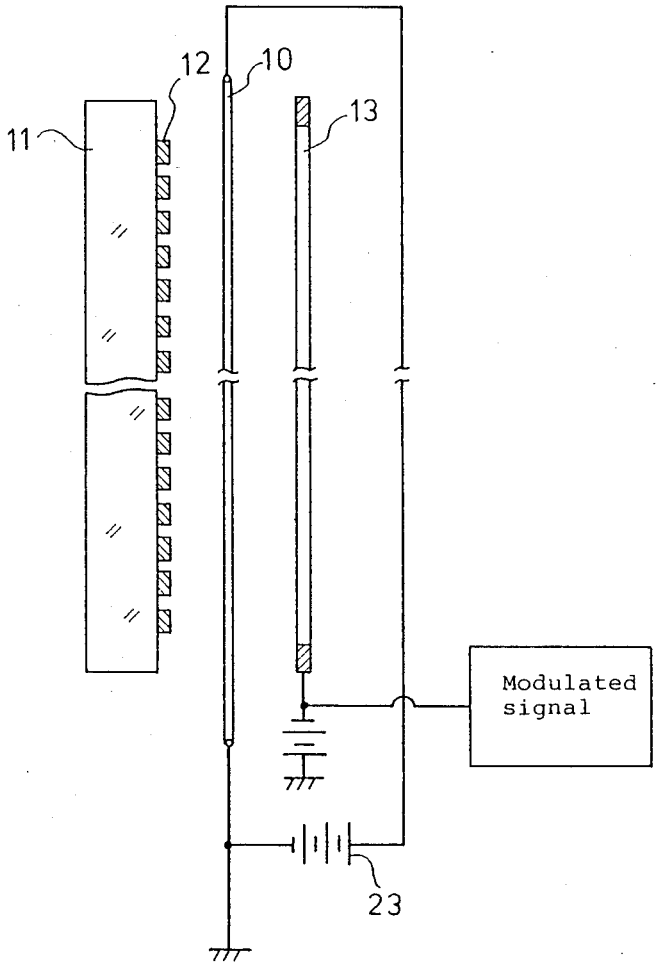
FIG. 4 (Prior Art)
FIG. 4 is the schematic vertical sectional view of the rear part of the flat type cathode ray tube of FIG. 1.

FIG. 15 shows configuration of a part of the flat type cathode ray tube shown in FIG. 1, wherein vertical scanning electrodes 12 of horizontal strips of metal are provided in a vertical row on an insulator panel 11, such as of glass, for vertical scanning electron beams by their switching operation. The vertical electrodes 12 are in general made by patterning of transparent electrode or metal film by photo-etching working on the insulator panel such as of glass. Between the vertical scanning electrodes 12 and the first grid 13, one or plural line cathodes 10 are stretched with a predetermined pitches, in a direction perpendicular to the strips of the vertical scanning electrode and with alignment to electron beam passing apertures of the first electrode 13. The line cathodes 10 are made by tungsten wires 30 of 15–50 μm diameter having electron emitting oxide layer 25 of about 5–20 μm thickness, as shown in FIG. 17. The line cathode 10 are stretched by resilient fixing means at one end or both ends. In the example of the figure, one end is fixed to a fixing member 26 and the other end is fixed to a resilient holder 27 on an insulator panel 11, respectively by welding or the like method. At both ends of the line cathodes 10, as shown in FIGS. 16 and 17, the electron emitting oxide layer 25 is removed. A line-shaped damper 48 is stretched perpendicularly to the line cathode 10 in a manner to lightly touch them. For the line-shaped damper 48, thread of insulative material (for instance, glass fiber) or a metal wire coated with insulating substance (for instance, glass or $Al_2O_3$). Anyway, at least the parts of the damper wire touching the line cathodes 10 are of insulating material. Accordingly, there is no fear of mutually shortcircuiting the line cathodes 10 by touching of the damper 48. The line-shaped damper 48 is fixed by its both ends on the fixing pieces 41 which are bonded by an adhesive on the insulator panel 11, in a manner to light-touchingly cross the line cathodes 10, or disposed almost to touch on the line cathodes 10 at their parts where the electron emitting oxide layer 25 is removed. In the example of the drawing, the fixing pieces 41 are proivded on both ends of each line cathode 10, but the fixing pieces 41 are not necessarily provided at the whole of such places, or the damper 48 needs not be fixed to whole of the fixing pieces 41.

Operation of the above-mentioned embodiment is explained. When the flat type cathode ray tube receives mechanical vibration, the line cathodes do not make undersirable vibration, since they are held by the damper 48. Accordingly, undesirable shortcircuiting of the line cathodes 10 with the vertical scanning electrodes 12 or the first grid 13 can be prevented. In the actual operation, the line cathodes are heated to a temperature of above 600° C. to emit thermal electron, and in such case the tungsten core wire 30 in each line cathode expands about 1 mm or more for every 300 mm depending on its line expansion coefficient by the heating by current. That is, in the center part of the line cathode 10, the expansion becomes over 0.5 mm. Therefore, the line cathodes 10 is subject to friction at ON-OFF of the heating current of the line cathodes. However, as a result of removing the electron emitting oxide layer 25 at the parts to touch the wire-shaped damper 48, or along the whole length of the line cathode there is no fear that the electron emitting oxide layer 25 drops off and sticks on the first grid 13 or the vertical deflection electrodes 12, hence, to make undersirable influence on the electron beam. Furthermore, since the electron emitting oxide layer 25 is removed only at the side of the line cathode 10 which is opposite to the side facing the first grid 13, such partial removing of the electron emitting oxide layer does not substantially influence the electron beam generation.

The line-shaped damper 48 can be of course provided in plural positions with respect to each line cathode 10.

Figure 18:
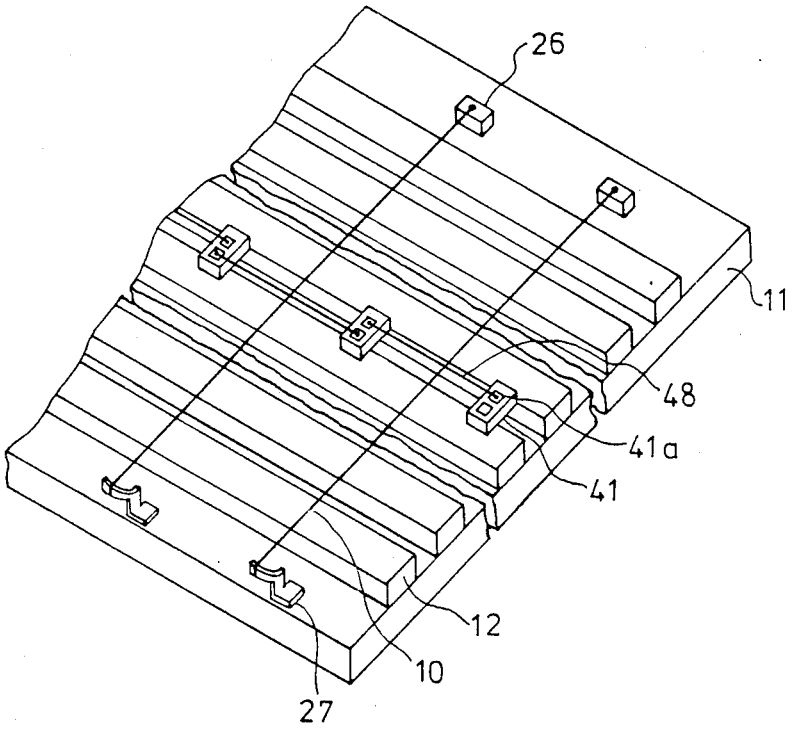
FIG. 18 is a perspective view of still another embodiment.

Still another embodiment is explained with reference to FIG. 18. In this example, the line-shaped damper 48 is provided in electrically independent manner with respect to each cathode. That is on the insulator panel 11, plural fixing pieces 41 are fixed by bonding or the like means on both sides of the line cathode 10. The fixing pieces 41 are made of insulating material, and two small metal pieces **41*a* are provided each other isolated and apart, and on each metal pieces 41*a*, the line-shaped damper 48** are fixed and stretched by welding or the like means.

In this example, since the dampers 48 are isolated from each other, even when they are made of metal wire the line cathodes 10 will not short-circuit each other. Of course, the dampers 48 may be made of insulated thin rods as shown in the embodiment of FIG. 15. Though in the embodiment of FIG. 18 the dampers 48 are disposed in staggered way, it is not always necessarily to be so, and they may be disposed on the same line if they are electrically isolated each other. The dampers 48 may be formed in plural number for each line cathode. Other details of the configuration are the same as the aforementioned embodiment.

The fixing pieces 41 for fixing the line cathodes may be provided on the first grid 13. Furthermore, by disposing the wire-shaped dampers 48 at intermediate positions between neighboring horizontal conductor strips of the vertical scanning electrodes 12 or electron beam passing apertures in the first grid 13, electric influence to the electron beams passing through the apertures of the first grid can be avoided as much as possible. The dampers 48 provided to touch the line cathodes 10 need not necessarily be perpendicular to the line cathodes 10, but may be obliquely crossing; anyway the dampers are needed only to cross the line cathodes. In the above-mentioned embodiments, dampers 48 are provided on the side opposite to the phosphor screen on the line cathodes, but it is possible to configure such that the dampers 48 are provided on the side of the phosphor screen 7 of the line cathodes 10 and electron emitting oxide layer 25 of the line cathodes 10 is partly removed at the parts to touch the wire-shaped dampers 48.

As is obvious from the above-mentioned elucidation, in the above-mentioned embodiment, such parts of the electron emitting oxide layer 25 of the line cathodes 10, that touches the line cathodes 10 disposed in crossing manner to the wire-shaped dampers, are partly or wholly removed; and the dampers 48 are touched to the line cathodes 10 or disposed in close proximity. Accordingly, vibration of the line cathodes 10 is prevented by the wire-shaped damper 48, and therefore electric shortcircuiting of the line cathodes with other electrodes and resultant damaging can be prevented. Of course, the electron emitting oxide layer 25 on the line cathodes on the side of the wire-shaped damper 48 is removed, hence peeling off of the electron emitting oxide layer 25 from the surface of the line cathodes 10 by touching with the wire-shaped dampers 48 and the line cathodes 10 can be prevented; and therefore electron emission can be maintained for long time, and besides sticking of the peeled off substance from the electron emitting oxide layer onto other electrodes and resultant undesirable influence on electron beam travelling is pevented.

Figure 19:
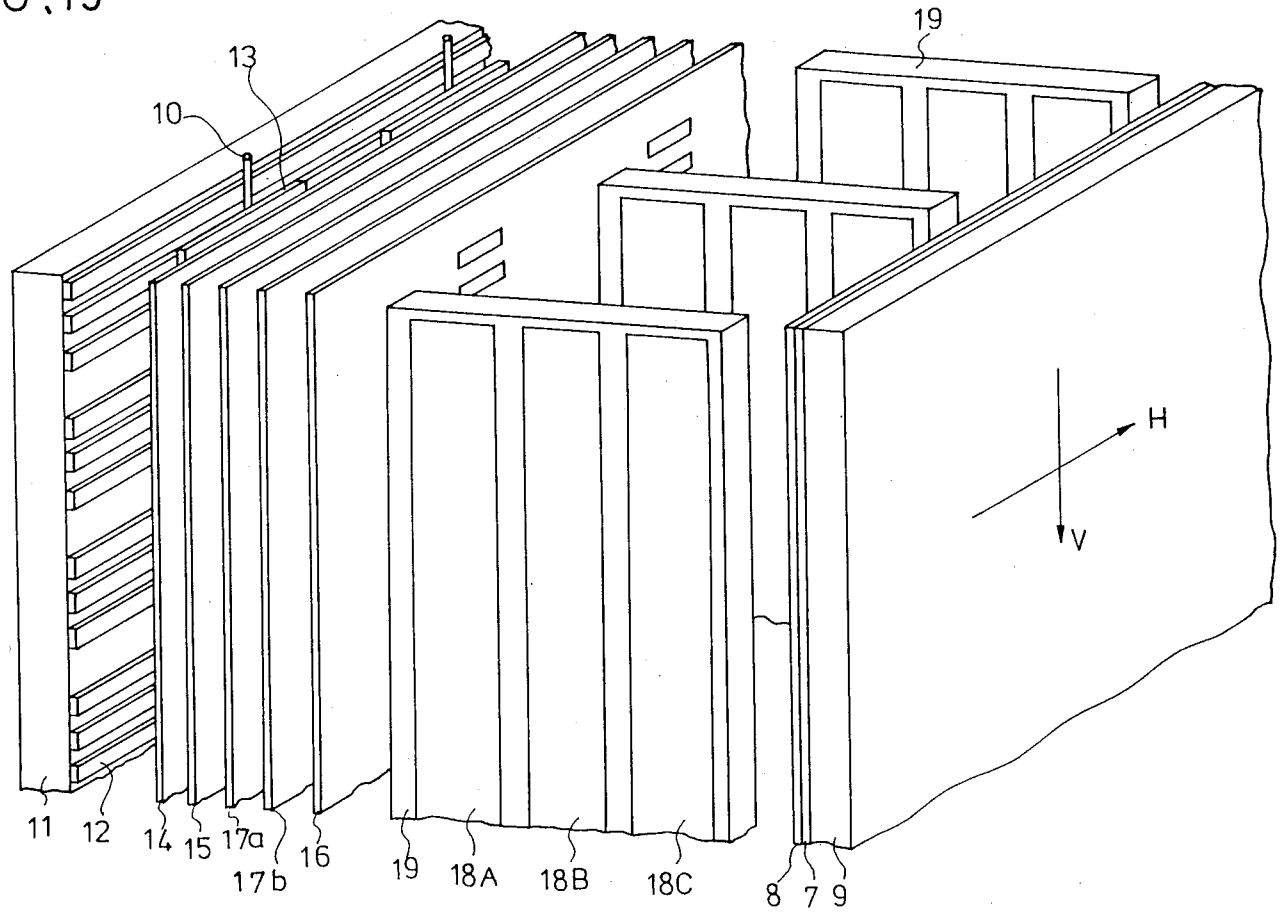

FIG. 19 shows another embodiment. In FIG. 19, for clarities sake of showing horizontal direction and vertical direction of the picture screen, horizontal arrow H and vertical arrow V are shown on the surface of the glass face plate 9. The flat type cathode ray tube of this embodiment comprises a number of line cathodes 10 which are parallelly disposed in vertical row with a predetermined uniform pitch in horizontal direction therebetween. Each line cathode 10 is stretched between spring holders 27 which are fixed on an insulator panel 11 made of glass or the like material. Each line cathode has electron emitting oxide layer on its surface, and in case size of display screen is for instance 10 inches in horizontal direction, the pitch in the horizontal direction may be 10 mm, and about 20 vertically disposed line cathodes of about 160 mm length are disposed on an imaginally vertical plane. Behind the row of the line cathodes 10, a row of vertical scanning electrodes 12 which are horizontally disposed each-other-insulated conductive strips, are disposed on the insulator panel 11. The vertical scanning electrodes 12 are, by scanningly applied pulses in turn to respective electrodes, controls emissions of electron beams from the parts of the line cathodes disposed in from thereof, and thereby resultantly make vertical scanning of emitted electron beams. Number of the vertical scanning electrodes 12 may be, in general, selected half the number of horizontal scanning lines, (in case of NTSC system the number is 480), and hence, pitches between the vertical scanning electrodes 12 in this example is selected to be twice the pitch of the horizontal scanning lines; and further, a larger pitches (i.e., pitches for m ($m>1$) lines) than the above-mentioned uniform pitches are disposed at every X horizontal scanning lines ($X>2$). In the example of FIG. 19, after every 3 horizontal scanning lines ($X=3$), a pitch for one line ($m=2$) is provided. The vertical scanning electordes are made by transparent electrode or metal film by photo-etching working on the insulating plate of glass in a manner to make electrically divided horizontal strips. The flat type cathode ray tube further comprises a first grid ($G_1$) 13, a second grid ($G_2$) 14, a third grid ($G_3$) 15, vertical deflection electodes 17*a* and 17*b*, a fourth grid ($G_4$) 16, horizontal deflection electrodes 18A, 18B, 18C formed on insulator plates 19, a metal back electrode 8, a phosphor screen 7 and a face panel 9 which supports the last two members, in the above-mentioned order. The first grid 13 has vertical slits formed correspondingly in front of the line cathodes 10 and is divided and electrically isolated for respective parts, corresponding to each line cathode, so as to make beam current modulation for individual line cathode.

Figure 20:
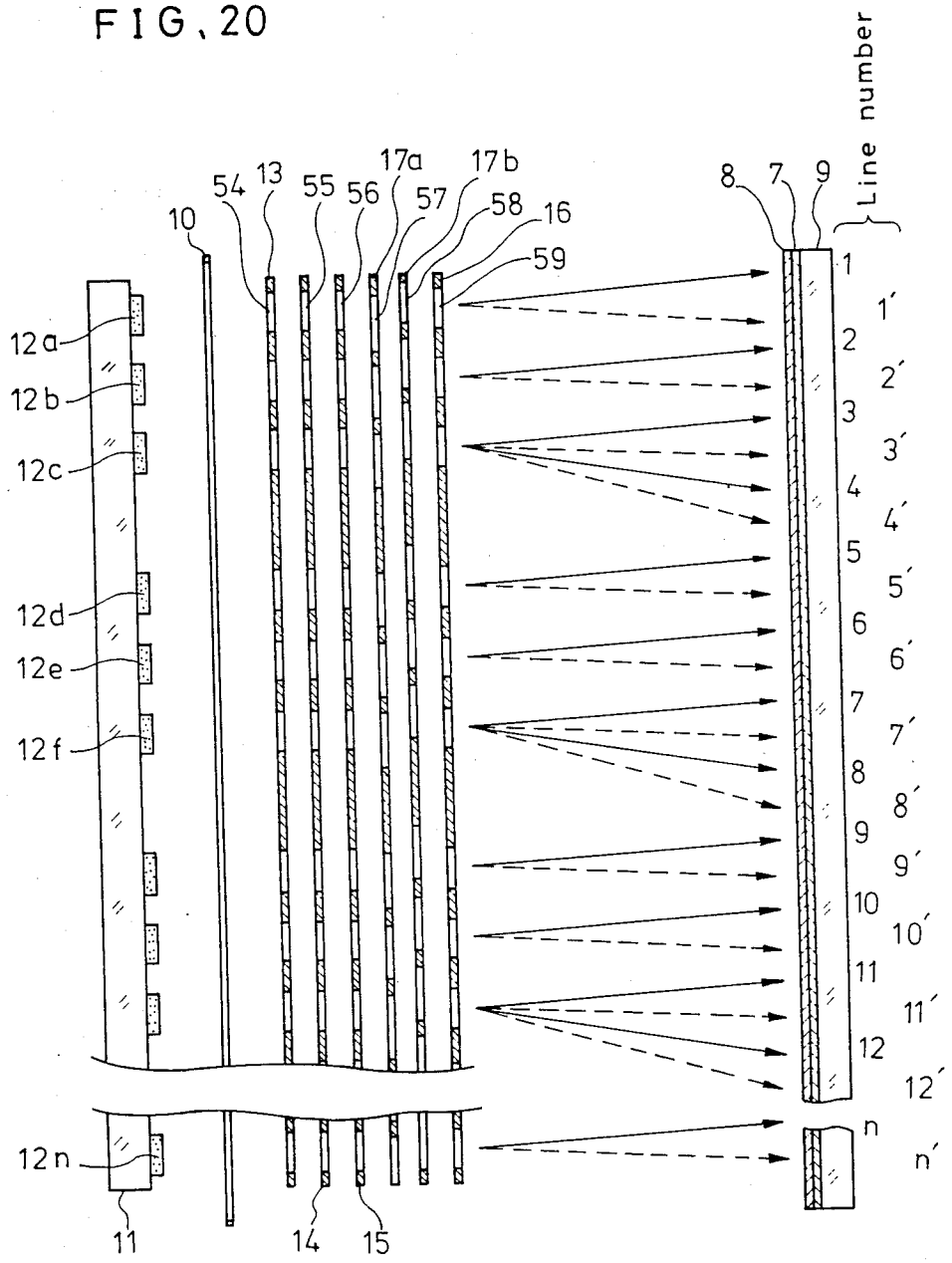

The second grid 14 is formed as one sheet and has vertical apertures similar to that of the first grid 13, namely it has electron beam passing apertures 55 as shown in FIG. 20.

The third grid 15 has a similar configuration to the second grid 14, namely has electron beam passing apertures 56 as shown in FIG. 20. The vertical deflection electrodes 17*a* and 17*b* are making a pair which has electron beam passing apertures 57, 58, as shown in FIG. 20.

Electron beam passing apertures 57 and 58 are disposed in staggered relation as shown in FIG. 20 in a manner that respective one sides of the apertures 57 and 58 are each other superposed so as to enable passing of respective electron beams. These vertical deflection electrodes 17*a* and 17*b* are for appliction of vertical deflection voltage signal as is described later.

The fourth grid 16 has a number of horizontally oblong small slits, whose widths are no less than widths of vertical slits of the second grid 14 or the third grid 15, namely has electron beam passing apertures 59 as shown in FIG. 20. The fourth grid 16 is impressed with appropriate beam focussing potential similarly to the thrid grid 15.

The horizontal deflection electrodes 18A, 18B, 18C are formed by plating or vacuum deposition or the like means on insulator plates 19, 19 . . . which are disposed vertically and in parallel direction with running direction of the electron beams. And the horizontal deflection electrodes 18A, 18B, 18C are for making horizontal deflection and horizontal focussing; and the horizontal deflection electrodes are disposed in symmetry with position of non-reflected electron beams from respective line cathodes, hence with the same pitch in horizontal direction as the pitch in horizontal direction of the line cathodes 10. In case of color displaying, the phosphor screen 7 comprises strips or dots of red phosphor, green phosphor and blue phosphors.

Figure 22:
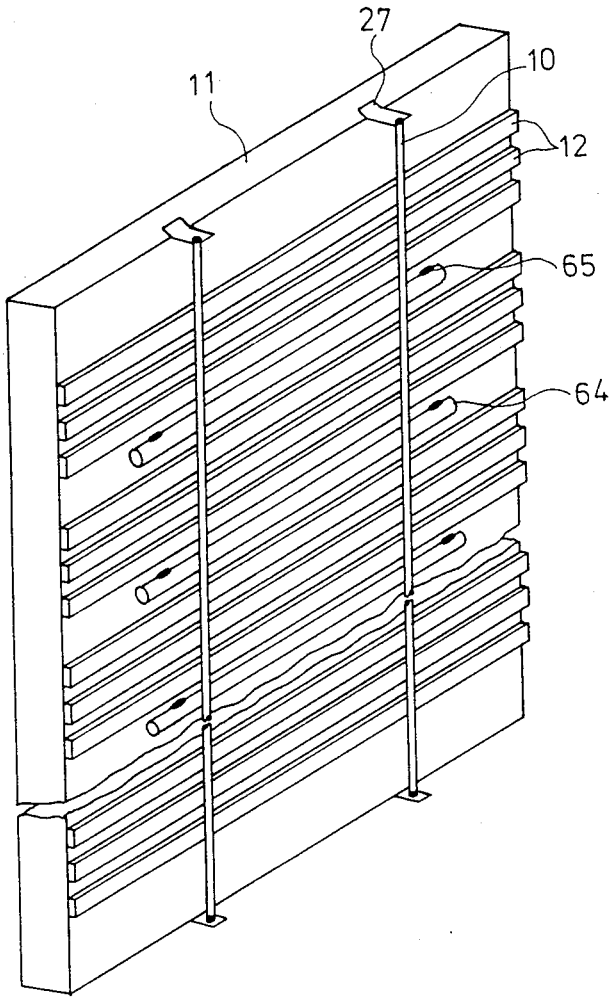

The afore-mentioned line cathodes 10 are held by fixing pieces 64 as shown in FIG. 22. The fixing pieces 64 are provided in a wide gap region having width of ($m-1$) horizontal lines ($m>1$) disposed at every X horizontal lines ($X>2$). By means of such fixing pieces 64, the line cathodes 10 are held so as to prevent undesirable vibration. The fixing pieces 64 are thin rod-shaped insulative material or conductor, and is bonded on the insulator panel 11 by adhesive 65 or the like means, in a manner to be in close proximity to or touching the line cathodes 10.

Next, operation of the above-mentioned flat type cathode ray tube is elucidated with reference to FIG. 20. By flowing heating current in the line cathodes 10, the line cathodes are heated, and substantially the same potential as those of the line cathodes 10 are applied to the first grid 13 and the vertical scanning electrode 12. At that time, electron beams, which are generated by the above-mentioned heating current in the line cathodes 10, travel towards the first grid 13 and second grid 14, by application of voltage to the grids in a manner that a higher voltage (about 100–500 V) than the potential of the line cathodes 10 is applied to the second grid 14, so that the electron beams pass through the slits formed on the grids 13.

Figure 21:
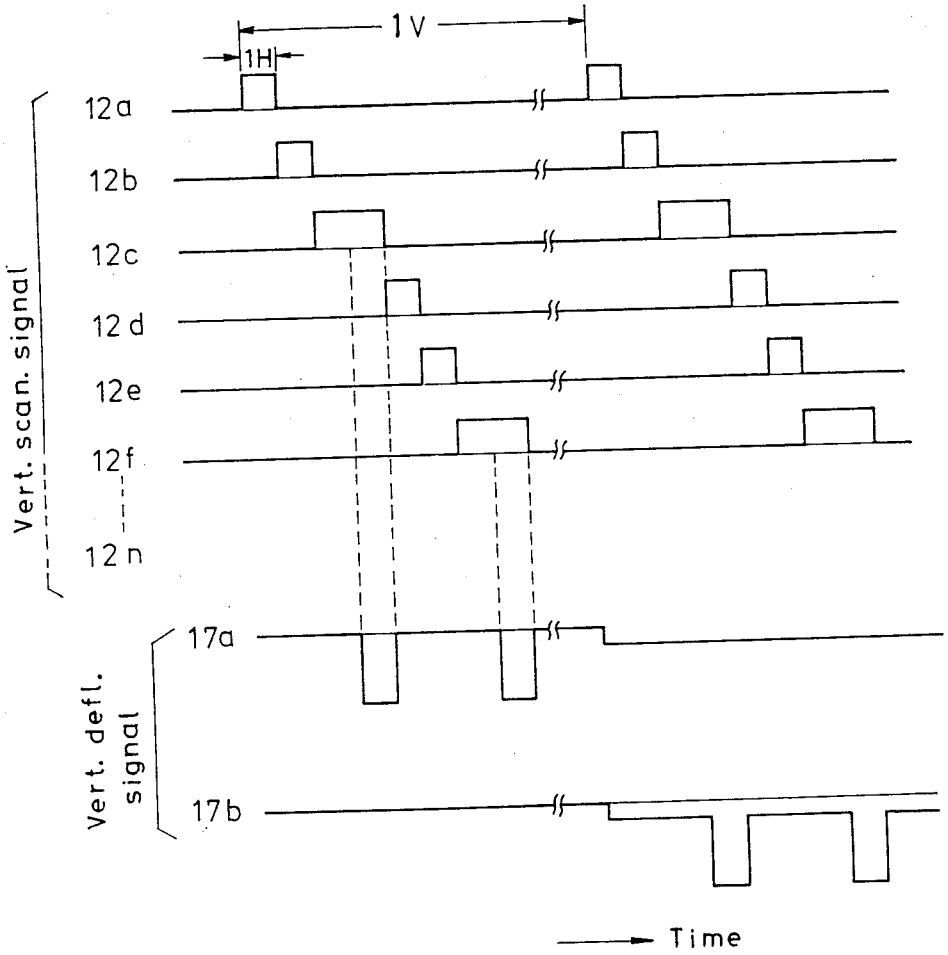

Vertical scanning is elucidated with reference to FIG. 21. As aforementioned, by controlling voltages of the vertical scanning electrodes 12 to positive or negative thereby inducing a positive or negative potential in the spaces surrounding the line cathodes 10, respectively, for generation (ON) or ceasing (OFF) of the electron beams from the line cathodes 10. At this time, in case the vertical scanning is used for TV display, the scanning is made, as above-mentioned, with a pitch twice of the pitch of the horizontal lines, and the vertical scanning electrodes 12, 12 are disposed with gaps of ($m-1$) horizontal lines ($m>1$) at every X horizontal lines ($X>2$).

Signals shown in FIG. 21 are impressed on these vertical scanning electrodes 12*a*–12*n* corresponding to positions of vertical lines 12*a*–12*n* on the phosphor screen shown in FIG. 20.

Firstly, to top vertical deflection electrode 12*a*, a potential to generate electrons from the line cathodes 10 towards the first grid 13 is applied for 1 horizontal scanning period in every 1 field range (IV); and next, to the second vertical deflection electrode 12*b*, a potential to generate electrons from the line cathodes 10 towards the first grid 13 is applied for 1 horizontal scanning period in every 1 field range (IV); and thirdly to the third vertical deflection electrode 12*c*, a potential to generate electrons from the line cathodes 10 towards the first grid 13 is applied for 1 horizontal scanning period in every 1 field range (V); and thereafter the similar operations are made in sequence to the bottom vertical deflection electrode 12*n*. And thus, electronic switchings for the vertical scanning is made. Electron beams which is scanningly generated in the above-mentioned way, is then subject to modulation, beam focussing and the like, by means of various electrodes disposed between the line cathodes 10 and the phosphor screen. Interlace operation and vertical deflection are made by a pair of vertical deflection electrodes 17*a* and 17*b* having electron beam passing apertures 57 and 58, which are staggeredly disposed in vertically shifted positions. State of travelling of the electron beams in these operations are shown in FIG. 20. The electron beams corresponding to the top vertical scanning electrode 12*a* make a line in the upper part 1 of the picture; next, electrons corresponding to the second vertical scanning electrode 12*b* makes a line in the second part 2 of the picture; and electrons corresponding to the third vertical scanning electrode 12*c* makes a line in the third part 3 of the picture; and thereafter parts 4 and so on makes lines in sequence. At that time, the vertical scanning electrode 12*c* receives the voltage to generate electrons for 2H period, and at the same time, the vertical deflection electrodes 17*a* and 17*b* are impressed with a voltage signal for vertically (downwards) deflecting the electron beams which are generated by application of the voltage to the vertical scanning electrode 12*c*. Thereafter, by making similar operations for electron beams corresponding to the vertical scanning electrode 12*b* to 12*n*, a first one vertical scanning is completed. Next, a second one vertical scanning period of the interlace scanning is made. This is made by shifting the lines downwards by half pitch of the vertical scanning electrodes. For the electron beam corresponding to the vertical scanning electrode 12*a*, a voltage to deflect the electron beams to 1′ part which is between the parts 1 and 2; and for the electron beam corresponding to the vertical scanning electrode 12*b*, a voltage to deflect the electron beams to 2′ part which is between the parts 2 and 3; and for the electron beam corresponding to the vertical scanning electrode 12*c*, a voltage to deflect the electron beams to 3′ part which is between the parts 3 and 4. And thereafter, similar vertical scannings are made, and thereby the electron beam scannings are made for 2H (two horizontal scanning) periods. By making the operation similarly to the electron beams corresponding to the bottom vertical scanning electrodes 12*n*, one vertical scanning is completed.

In the above-mentioned embodiment, even when the line cathodes 10 undesirably vibrates, which may be triggered by electric or mechanical forces, the above-mentioned holder 64 causes a damping effect, and therefore electric short-circuit between the vertical scanning electrodes 12*a*, 12*b*, . . ., and the line cathodes 10 do not occur. Furthermore, the suppressing of the vibrations stabilizes electron flow from the cathodes 10.

Though in the above-mentioned embodiment the insulator panel 11 to hold the vertical scanning electrodes 12 is formed as an integral one, this may be divided in plural insulator panels in the horizontal direction. Furthermore, though the vertical scanning electrodes 12 are provided with pitches of twice the pitch of the horizontal scanning lines, the disposition of vertical scanning electrodes 12 may be provided with the same pitch as the horizontal scanning lines, making gaps of $(m-1)$ lines $(m>1)$ after every X horizontal lines $(X>2)$. In this modified example, by means of combination of the switching of the vertical scanning electrodes 12 and the vertical scanning, the interlacing and picture scanning can be made. Furthermore, the vertical scanning electrodes 12 can be disposed with pitch of n times $(n>1)$ of the horizozntal scanning lines, disposing gaps of $(m-1)$ horizontal lines $(m>1)$ after every X horizontal lines $(X>2)$; and by making the electron beams for $n\times 1H$ period and $(l+K)\times 1H$ period $(l>1, K>1)$ or making them pass and vertically deflecting the picture, the similar effect is obtainable. Apart from the configuration of the abovementioned embodiment wherein the vertical scanning electrodes 12 are provided on the back side of the line cathodes 10, the vertical scanning electrodes 12 may be provided between the line cathodes 10 and the subsequent electrodes or grids, which is disposed in down stream position with respect to the electron beams. In such modified example, the vertical scanning electrodes 12 are provided with electron beam passing apertures. Furthermore, apart from the configuration of the vertical deflection electrodes 17*a* and 17*b*, which are sheet type electrodes having electron beam apertures and disposed perpendicular to the travelling direction of the electron beams in sequence of the electron beam travelling course, other modification may be made, such that the vertical deflecting electrodes comprises plural of sheet-shaped electrodes disposed each other in parallel to and on both sides of each electron beam, like the horizontal deflecting electrode 18A, 18B, 18C. The number and actual positions of the vertical deflection electrodes may be changed. Furthermore, apart from the above-mentioned configuration wherein the line cathodes 10 are disposed in the vertical direction (V), another configuration may be possible such that whole apparatus is turned by 90° around the axis of the cathode ray tube, and hence the line cathodes 10 are stretched horizontally parallel and the scanning electrodes 12 are disposed parallelly on an insulator panel 11 in vertical direction, is used for horizontal deflection of the electron beams.

As is obvious from the above-mentioned explanation, the scanning electrodes 12 are disposed in perpendicular relation to the line cathodes, and the scanning electrodes 12 are disposed with narrower pitches and wider pitches as shown in FIG. 19, FIG. 20 and FIG. 22. Thereby, the electron beams from the line cathodes are deflected in the direction to the longitudinal direction of the line cathodes. Accordingly, it is possible to manufacture the vertical scanning electrode in divided pieces, and therefore, manufacture of a large sized flat type cathode ray tube is easy. And for the gap parts wherein the vertical scanning electrodes and the line cathode are omitted, by means of vertical deflection electrodes disposed between the line cathodes and the phosphor screen, necessary lines can be produced by vertically deflecting at least a part of electron beams, and then a complete picture is obtainable. Furthermore, the wide gap parts between the vertical scanning electrodes can be utilized for fixing the holder or fixing pieces of the dampers. And by means of such dampers, undesirable vibration of the line cathodes are prevented, hence preventing damaging of the line cathodes and other electrodes, and further can stabilize electron flow from the cathode and hence the produced picture.

Figure 23:
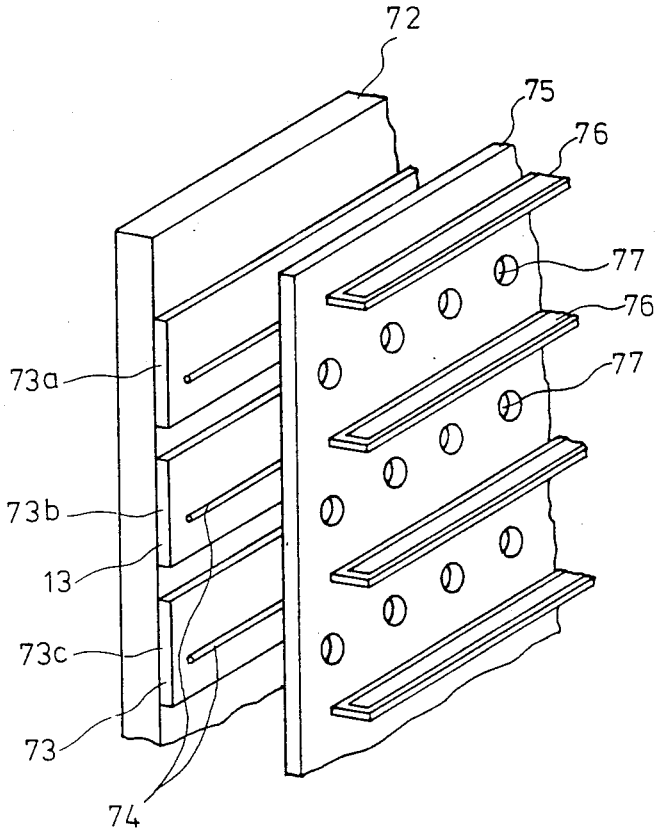
FIG. 23 is a partial perspective view of electron source part of still another embodiment.

FIG. 23 shows a configuration of electron beam source part of still another embodiment of the flat type cathode ray tube.

In FIG. 23, numeral 72 designates an insulator panel which may be a part of the vacuum enclosure; *73a, 73b, 73c* . . . back electrodes of conductive film and electrically divided each other; 74 a line electrode provided in front of the back electrodes isolated therefrom; 75 a first grid having electron beam passing apertures 77; 76 pairs of vertical deflection electrodes, each pair being correspondingly disposed to the electron beams from respective line cathodes 74. Other electrode configuration is the same as disclosed in the U.S. Pat. No. 4,449,148.

Figure 24:
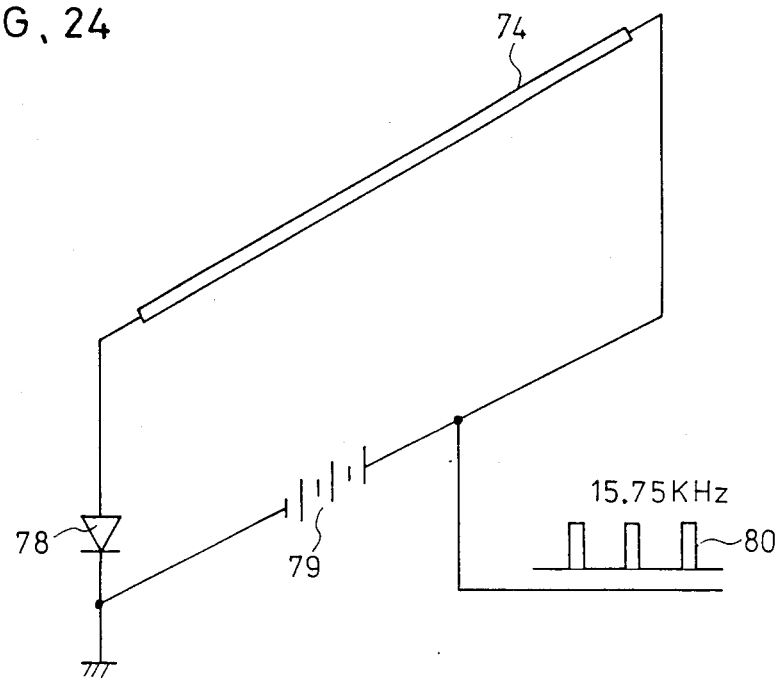
FIG. 24 is a circuit diagram showing a driving circuit of the line cathodes of the embodiment of FIG. 23.
Figure 25:
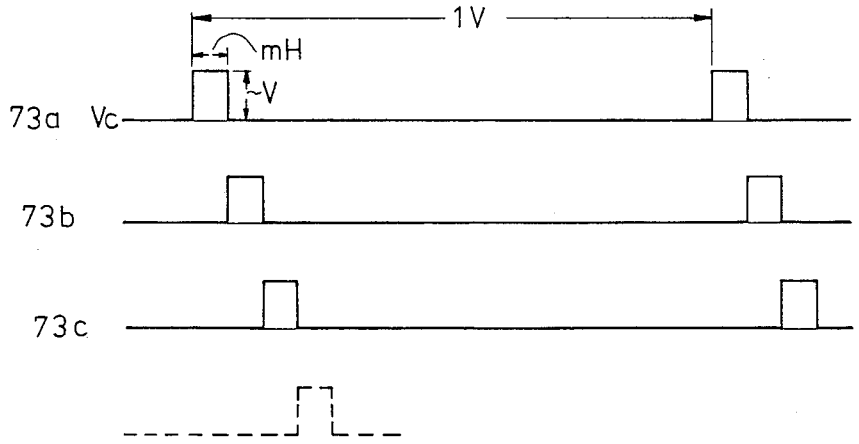
FIG. 25 is a time chart of wave forms of signals to be impressed on rear side electrodes.

Operation of the above-mentioned embodiment is elucidated with reference to FIG. 23, FIG. 24 and FIG. 25. In FIG. 23, the back electrodes 73 are made by transparent electrodes or metal film electrodes formed on the insulator panel and electrically divided corresponding to the line cathodes 74. The back electrodes 73 and the corresponding line cathodes 74 are disposed with a predetermined parallel gap in between. The line cathodes 74 are oblong and horizontally disposed in parallel; and a predetermined number of the line cathodes are disposed in vertical row. The line cathodes 74 are made by tungsten wires of 10–50 μm diameter having electron emitting oxide layer of about several to several tens μm thickness. The line cathodes 74 are stretched by a spring or springs at one end or both ends. A first grid 75 is disposed with a predetermined gap against the line cathodes 74 and has electron beam passing apertures 77 for taking out electrons generated by heating the line cathodes, at corresponding positions to the line cathodes 74. The shape, size and pitch distance of the electron beam passing apertures 77 are matters of design choice. But as one example of a flat type cathode ray tube having picture size of 10 inches, number of the apertures in horizontal direction is 200 and number in vertical direction is selected equal to number of line cathodes. Next, vertical deflection electrodes 76 are made to make pairs, in a manner that each pair is disposed horizontally and parallelly on both sides of the apertures 77. The horizontal deflection electrodes 76 may be of single metal strip, or alternatively, made by vacuum deposition or screen printing of conductive film on both sides of insulative substrate. Each pair of the vertical deflection electrodes 76 are impressed with deflection voltage signal, such as, saw tooth wave or step wave. And they make vertical deflection for all the electron beams passing the electron beam passing apertures 77 in vertical direction within a predetermined angle.

Operation of the above-mentioned configuration is described with reference to FIGS. 24 and 25.

In FIG. 24, across both ends of the line cathode stretched by spring holder, heating voltage from a cathode heating power source 79 is applied to. Also is applied a pulse signal 80 for pausing the heating of the line cathode 74 during a short time for taking out electrons from the line cathodes 74 to avoid generation of potential difference along the line cathode. To one end of the line cathode 74, a diode 78 is connected to prevent inverse direction current. By setting the voltage of the pulse signal 80 to be lower than the potentials for the first grid 75, potential of the first grid 75 becomes higher than that of the line cathode 74. And thereby, electrons generated from the line cathode 74 are taken out towards the electrode 76. Hereupon, the line cathodes 74 are chords fixed at both ends thereof, and therefore, as has been described, have a natural vibration frequency $f_k$ which is determined by several constants. Coupling of the natural vibration frequency ($f_k$) and the pulse signal to be impressed on the line cathodes 74 is greatly related to higher harmonics wave of the pulse signal as aforementioned. Therefore, here frequency ($f_{kp}$) of pulse signal to be impressed on the line cathodes 74 in relation to the natural vibration frequency ($f_k$) of the line cathodes 74 is selected as $f_k < f_{kp}$. For an example, use of a frequency roughly close to horizontal scanning frequency (15.75 KHz) for the pulse signal frequency $f_{kp}$ makes the processing of the pulse signal easy. By adoption of such method, triggering undesirable vibration of the line cathode by electric induction is prevented.

Next, if the pulse signal were applied on all of the line cathodes 74, all the line cathodes undesirably emit electrons all the time, hence disabling vertical scanning. Therefore, as shown in FIG. 23, such pulse signal, as having potentials to generate electrons only for required time periods for emitting electrons from the line electrodes 74, is impressed to respective back electrodes, by making time differences or shifts for respective back electrodes *73a, 73b, 73c* . . . . And pulse signal having potentials to make all of the line cathodes to emit electrons only for necessary time period ($m \times 1H$) is impressed on the line cathodes 74. The state of such time shifted signals are shown in FIG. 25.

In this case, if 16 step vertical deflections of the electron beams generated from respective line cathodes 74 is intended, as pulse signal to be impressed for such deflection on the back electrode 73 becomes signal of 16H pulse width in other words, $m=16$. Besides, the pulse voltages are selected such that only for the mH periods the voltage is V which is necessary to emit electrons from the line cathodes, and for remainder periods the voltage is a cut off voltage $V_c$ which is more negative than the cathode voltage 74 so as not to send electrons from the line cathode 74 to the first grid 75.

Apart from the above-mentioned embodiment, the back electrode for controlling the scanning of the electron beam emission may be configurated such that it is an integral one without division, combined with a divided grid which is disposed between the line cathodes and the phosphor screen and is divided corresponding to respective line cathodes, and other parts are the same as the previous embodiments. The flat type cathode ray tube of such configuration has the similar operation and effect to the preceding embodiments.

What is claimed is:

1. An electron beam scanning display apparatus comprising:

a plurality of line cathode holders;

a plurality of line cathodes, each stretched between a pair of said holders;

a plurality of scanning electrodes which are insulated from each other and disposed substantially perpendicular to a direction of said line cathodes, a space formed between scanning electrodes and said line cathodes, said scanning electrodes for producing electron beams by application of predetermined potentials thereto;

a face plate disposed facing said plurality of line cathodes with a certain distance therebetween and having a display screen on an inner face thereof;

deflection electrodes disposed between said line cathodes and said face plate for deflecting at least a part of said electron beams;

vibration suppressing means for suppressing vibration of said line cathodes, wherein each line cathode is connected by one end to a pulse signal source and by the other end through a diode to a line cathode power source;

said pulse signal source being for impressing a pulse signal of a predetermined voltage and of an inverse direction to said diode for turning it to an OFF state for a duty period of said pulse, and having a higher frequency than a natural vibration frequency of said line cathode.

2. An electron beam scanning display apparatus in accordance with claim 1, wherein said pulse signal is in synchronism with a horizontal scanning frequency.

3. An electron beam scanning display apparatus comprising:

a plurality of line cathode holders;

a plurality of line cathodes, each stretched between a pair of said holders;

a plurality of scanning electrodes which are insulated from each other and disposed substantially perpendicular to a direction of said line cathodes, a space formed between said scanning electrodes and said line cathodes, said scanning electrodes for producing electron beams by application of predetermined potentials thereon;

a face plate disposed facing said plurality of line cathodes with a certain distance therebetween and having a display screen on an inner face thereof;

deflection electrodes disposed between said line cathodes and said face plate for deflecting at least part of said electron beams; and vibration suppressing means for suppressing vibration of said line cathodes, wherein said vibration suppressing means comprises at least one wire-shaped damper means, having a free end part touching one of said line cathodes, and another end thereof which is fixed.

4. An electron beam scanning display apparatus in accordance with claim 3; wherein said wire-shaped damper means is formed of metal wire having an insulative coating on its surface or insulative substance wire.

5. An electron beam scanning display apparatus in accordance with claim 3, wherein said display screen has a phosphor screen.

6. An electron beam scanning display apparatus in accordance with claim 3, wherein each of said line cathodes comprises an electron-emitting oxide layer, at least a part at one side thereof being removed, and said free end part of wire-shaped damper means being disposed to touch said part removed of electron-emitting oxide layer.

7. An electron beam scanning display apparatus in accordance with claim 6, wherein said wire-shaped damper means is formed of insulative substance wire which is a metal wire having an insulative coating on its surface.

8. An electron beam scanning display apparatus in accordance with claim 6, wherein said wire-shaped damper means are metal wires which are electrically isolated from each other for respective line cathodes.

9. An electron beam scanning display apparatus in accordance with claim 6, wherein said wire-shaped dampers are provided on a side opposite to said display screen with respect to said line cathodes.

10. An electron beam scanning display apparatus in accordance with claim 6, wherein said scanning electrodes include a plurality of strip electrodes disposed on a back side of said line cathodes, and said wire-shaped dampers are disposed in a gap between said plural strip electrodes.

11. An electron beam scanning display appparatus in accordance with claim 3, wherein said plural scanning electrodes are disposed to have a wider gap after every predetermined number of plural narrower gaps.

12. An apparatus as in claim 3, wherein said wire-shaped damper means comprises a plurality of wire-shaped dampers, each having a free end touching one of said line cathodes, each of said line cathodes provided with one of said wire-shaped damper means.

13. An electron beam scanning display apparatus comprising:

a plurality of line cathode holders;

a plurality of line cathodes, each stretched between a pair of said holders;

a plurality of scanning electrodes which are insulated from each other and disposed substantially perpendicular to a direction of said line cathodes, a space formed between said scanning electrodes and said line cathodes, said scanning electrodes for producing electron beams by application of predetermined potentials thereto;

a face plate disposed facing said plurality of line cathodes with a certain distance therebetween and having a display screen on an inner face thereof;

deflection electrodes disposed between said line cathodes and said face plate for deflecting at least a part of said electron beams; and vibration suppressing means for suppressing vibration of said line cathodes, wherein said vibration suppressing means comprises at least one wire-shaped damper means, having both free end parts thereof touching one of said line cathodes and an intermediate part thereof being fixed.

14. An electron beam scanning display apparatus in accordance with claim 13, wherein said wire-shaped damper means is formed of metal wire having an insulative coating on its surface or insulative substance wire.

15. An apparatus as in claim 13, wherein said wire-shaped damper means comprises a plurality of wire-shaped dampers, each having said free ends touching one of said line cathodes, each of said line cathodes provided with one of said wire-shaped damper means.

16. An electron beam scanning display apparatus comprising:

a plurality of line cathode holders;

a plurality of line cathodes, each stretched between a pair of said holders;

a plurality of scanning electrodes which are insulated from each other and disposed substantially perpendicular to a direction of said line cathodes, a space formed between said scanning electrodes and said line cathodes, said scanning electrodes for producing electron beams by application of predetermined potentials thereto;

a face plate disposed facing said plurality of line cathodes with a certain distance therebetween and having a display screen on an inner face thereof;

deflection electrodes disposed between said line cathodes and said face plate for deflecting at least a part of said electron beams;

vibration suppressing means for suppressing vibration of said line cathodes; and plural wire-shaped damper means, free ends of each wire-shaped damper means touching one of said line cathodes from different directions.

17. An electron beam scanning display apparatus in accordance with claim 16, wherein said wire-shaped damper means has free ends on both ends thereof and an intermediate part thereof being fixed.

18. An electron beam scanning display apparatus in accordance with claim 16, wherein said wire-shaped damper means is formed of metal wire having an insulative coating on its surface or insulative substance wire.

19. An electron beam scanning display apparatus in accordance with claim 16, wherein other ends of said plural wire-shaped damper means are fixed on a common holder.

20. An apparatus as in claim 16, wherein said free ends of said damper means contact said line cathode at points which are separated from one another by substantially 90°.

21. An apparatus as in claim 16, wherein said wire-shaped damper means comprises a plurality of wire-shaped dampers, each having a free end touching one of said line cathodes, each of said line cathodes provided with one of said wire-shaped damper means.

22. An electron beam scanning display apparatus comprising:

a face plate having a display screen thereon;

a plurality of line cathode holders;

a pulse signal source;

a diode;

a line cathode power source;

a plurality of line cathodes, each stretched between a pair of holders in a horizontal direction with respect to said display screen, on an imaginary plane disposed substantially in parallel with said display screen with a certain distance therebetween, each of said plural line cathodes being connected by one end to said pulse signal source and by the other end through said diode to a line cathode power source, said pulse signal source being for impressing a pulse signal of a predetermined voltage and of an inverse direction to said diode for turning it to an OFF state for a duty period of said pulse, and having a higher frequency than a natural vibration frequency of said line cathode.

23. An electron beam scanning display apparatus in accordance with claim 22, wherein said pulse signal is in synchronism with said horizontal scanning frequency.

24. An electron beam scanning display apparatus comprising:

a plurality of line cathode holders;

one or more line cathodes, each stretched between a pair of said holders;

a plurality of scanning electrodes which are insulated from each other and disposed substantially perpendicular to the direction of said line cathodes with predetermined spaces between said scanning electrodes and said line cathodes and behind said line cathodes, for producing electron beams by application of predetermined potentials thereto, said plural scanning electrodes being disposed to have a wider gap after every predetermined number of plural narrower gaps;

a face plate disposed facing said plural line cathodes with a certain distance therebetween and having a display screen on its inner face;

deflection electrodes disposed between said line cathodes and said face plate for deflecting at least a part of said electron beams; and vibration suppressing means for suppressing vibration of said line cathodes.

25. An electron beam scanning display apparatus in accordance with claim 24 which further comprises deflection signal source means for applying a pulse signal to said deflection electrode in a manner to deflect said electron beams by a larger amount during times of said pulse signal.

26. An apparatus as in claim 24, wherein said vibration suppressing means comprises wire-shaped damper means having a plurality of wire-shaped dampers, each having a free end touching one of said line cathodes, each of said line cathodes having a separate one of said wire-shaped damper means.

27. An electron beam scanning display apparatus comprising:

a plurality of line cathode holders;

at least one line cathodes each stretched between a pair of said holders;

a plurality of scanning electrodes which are insulated from each other and disposed substantially perpendicular to the direction of said line cathodes with predetermined spaces between said scanning electrodes and said line electrodes, for producing electron beams by application of predetermined potentials thereto, said plural scanning electrodes being disposed to have a wider gap after every predetermined number of plural narrower gaps;

a face plate disposed facing said plural line cathodes with a certain distance therebetween and having a display screen on its inner face;

deflection electrodes disposed between said line cathodes and said face plate for deflecting at least a part of said electron beams; and vibration suppressing means for suppressing vibration of said line cathodes, wherein at least three scanning electrodes are disposed with a pitch of at least two times a pitch of the horizontal scanning lines and with a wider interval than a pitch of at least two times the pitch of said horizontal scanning lines between every said at least three scanning electrodes.

28. An electron beam scanning display apparatus in accordance with claim 27, wherein said scanning electrodes, which are disposed with a pitch of at least two times a pitch of the horizontal scanning lines, are impressed with an electric potential to make said line cathodes selectively generate electron beams during a period of at least two times the horizontal scanning period, and an area outside one of said at least three scanning electrodes is impressed with an electric potential to make said line cathodes selectively generate electron beams during said period of said at least two times of horizontal scanning period.

29. An apparatus as in claim 27, wherein said vibration suppressing means comprises wire-shaped damper means having a plurality of wire-shaped dampers, each having a free end touching one of said line cathodes, each of said line cathodes having a separate one of said wire-shaped damper means.

30. An electron beam scanning display apparatus comprising:

a plurality of line cathode holders;

one or more line cathodes each stretched between a pair of said holders;

a plurality of scanning electrodes which are insulated from each other and disposed substantially perpendicular to the direction of said line cathodes with predetermined spaces between said scanning electrodes and said line electrodes, for producing electron beams by application of predetermined potentials thereto, said plural scanning electrodes being disposed to have a wider gap after every predetermined number of plural narrower gaps;

a face plate disposed facing said plural line cathodes with a certain distance therebetween and having a display screen on its inner face;

deflection electrodes disposed between said line cathodes and said face plate for deflecting at least a part of said electron beams; and vibration suppressing means for suppressing vibration of said line cathodes, wherein said vibration suppressing means comprises wire-shaped damper means, a free end part thereof touching one of said line cathodes and another part thereof being fixed on said part of wider gap between said plural scanning electrodes.

31. An apparatus as in claim 30, wherein said vibration suppressing means comprises wire-shaped damper means having a plurality of wire-shaped dampers, each having a free end touching one of said line cathodes, each of said line cathodes having a separate one of said wire-shaped damper means.

* * * * *